US009186678B2

(12) United States Patent
Xu et al.

(10) Patent No.: US 9,186,678 B2
(45) Date of Patent: Nov. 17, 2015

(54) SHREDDER AUTO FEED SYSTEM WITH PAPER STACK SEPARATION MECHANISM

(71) Applicant: Fellowes, Inc., Itasca, IL (US)

(72) Inventors: Xiao Guang Xu, Suzhou (CN); Jian Liang Lyu, Suzhou (CN); Tai Hoon K. Matlin, Round Lake Beach, IL (US)

(73) Assignee: FELLOWES, INC., Itasca, IL (US)

( * ) Notice: Subject to any disclaimer, the term of this patent is extended or adjusted under 35 U.S.C. 154(b) by 374 days.

(21) Appl. No.: 13/652,363

(22) Filed: Oct. 15, 2012

(65) Prior Publication Data

US 2014/0103151 A1 Apr. 17, 2014

(51) Int. Cl.

| | |
|---|---|
| ***B02C 18/22*** | (2006.01) |
| ***B02C 18/00*** | (2006.01) |
| ***B02C 23/00*** | (2006.01) |
| ***B02C 23/02*** | (2006.01) |

(Continued)

(52) U.S. Cl.

CPC ..... *B02C 18/2233* (2013.01); *B02C 18/0007* (2013.01); *B02C 18/225* (2013.01); *B02C 18/2241* (2013.01); *B02C 18/2291* (2013.01); *B02C 23/00* (2013.01); *B02C 23/02* (2013.01); *B65H 3/047* (2013.01); *B65H 3/322* (2013.01); *B65H 5/025* (2013.01); *B02C 2018/003* (2013.01); *B65H 2301/5127* (2013.01)

(58) Field of Classification Search

CPC ..... B02C 18/0007; B02C 18/2241; B02C 18/2283; B02C 18/225

USPC ..... 241/224, 225, 222, 236, 100, 30

See application file for complete search history.

(56) References Cited

U.S. PATENT DOCUMENTS

| | | | |
|---|---|---|---|
| 4,192,467 | A | 3/1980 | Hatanaka |
| 4,231,530 | A | 11/1980 | Hatanaka |

(Continued)

FOREIGN PATENT DOCUMENTS

| | | | |
|---|---|---|---|
| CN | 1053778 | A | 8/1991 |
| CN | 1577132 | A | 2/2005 |

(Continued)

OTHER PUBLICATIONS

International Search Report (Form PCT/ISA/210) dated Dec. 4, 2013, for International Application No. PCT/US2013/062266 (four pages).

(Continued)

*Primary Examiner* — Mark Rosenbaum

(74) *Attorney, Agent, or Firm* — Pillsbury Winthrop Shaw Pittman LLP

(57) ABSTRACT

The present disclosure is generally related to an apparatus having cutter elements for destroying articles such as paper sheets and a mechanism for separating at least a sheet from a stack in a tray. A paper feed mechanism feeds paper that is separated from the stack by a stack separation mechanism to the cutter elements. The feed and separation mechanisms can be activated by rotation of the cutter elements. In one embodiment, the stack separation mechanism moves in an alternating manner between retracted and extended positions to disengage and engage and insert the stack to separate (with its edge) paper therefrom to feed to the feed mechanism for shredding. The paper stack separation mechanism can move in an non-undulating manner relative to the stack. A device for stripping stapled pages, a pivotable support plate, and pressure plate can also be used, as well as a number of sensors.

38 Claims, 13 Drawing Sheets

(51) Int. Cl.

| | |
|---|---|
| ***B65H 3/32*** | (2006.01) |
| ***B65H 5/02*** | (2006.01) |
| ***B65H 3/04*** | (2006.01) |

(56) References Cited

U.S. PATENT DOCUMENTS

| | | | | |
|---|---|---|---|---|
| 4,232,860 | A | 11/1980 | Brown | |
| 4,529,134 | A | 7/1985 | Williams | |
| 4,815,669 | A | 3/1989 | Fujii | |
| 4,815,670 | A | 3/1989 | Iwai | |
| 4,817,877 | A | 4/1989 | Itoh et al. | |
| 4,817,887 | A | 4/1989 | Harigaya et al. | |
| 4,821,967 | A | 4/1989 | Moriyama | |
| 4,878,626 | A | 11/1989 | Leuthold et al. | |
| 4,893,759 | A | 1/1990 | Mizobata | |
| 4,957,243 | A | 9/1990 | Kanagaki et al. | |
| 4,986,481 | A | 1/1991 | Fujii et al. | |
| 5,009,410 | A | 4/1991 | Fujii et al. | |
| 5,188,301 | A | 2/1993 | Hasegawa | |
| 5,261,614 | A | 11/1993 | Schwelling | |
| 5,362,002 | A | 11/1994 | Tsai | |
| 5,441,249 | A | 8/1995 | Todaro et al. | |
| 5,538,193 | A | 7/1996 | Takahashi et al. | |
| 5,662,280 | A | 9/1997 | Nishio et al. | |
| 5,743,473 | A | 4/1998 | Gregg | |
| 5,772,129 | A | 6/1998 | Nishio et al. | |
| 5,871,162 | A | 2/1999 | Rajewski | |
| 5,884,855 | A | 3/1999 | Chang | |
| 5,954,279 | A | 9/1999 | Siegfried et al. | |
| 6,332,607 | B1 | 12/2001 | Van Der Werff | |
| 6,390,397 | B1 | 5/2002 | Ko | |
| 7,040,559 | B2 | 5/2006 | Matlin et al. | |
| 7,500,625 | B2 | 3/2009 | Castronovo | |
| 7,500,627 | B2 | 3/2009 | Park et al. | |
| 7,823,873 | B1 | 11/2010 | Su | |
| 7,828,235 | B2 | 11/2010 | Matlin et al. | |
| 7,963,472 | B2 | 6/2011 | Odman et al. | |
| 8,123,152 | B2 | 2/2012 | Matlin et al. | |
| 8,167,223 | B2 | 5/2012 | Jensen et al. | |
| 2001/0011793 | A1 | 8/2001 | Suzuki et al. | |
| 2002/0070300 | A1 | 6/2002 | McLean et al. | |
| 2002/0190146 | A1 | 12/2002 | Irwin | |
| 2004/0135305 | A1 | 7/2004 | Bagrosky | |
| 2005/0023745 | A1 | 2/2005 | Morimoto et al. | |
| 2005/0072870 | A1 | 4/2005 | Dziesinski et al. | |
| 2005/0274836 | A1 | 12/2005 | Chang | |
| 2006/0054727 | A1 | 3/2006 | Ko | |
| 2006/0179987 | A1 | 8/2006 | Park et al. | |
| 2006/0249609 | A1 | 11/2006 | Huang | |
| 2007/0181722 | A1 * | 8/2007 | Dahle et al. | 241/235 |
| 2007/0235573 | A1 | 10/2007 | Johnson | |
| 2008/0179436 | A1 | 7/2008 | Kuraoka | |
| 2008/0197220 | A1 | 8/2008 | Tsai | |
| 2008/0210794 | A1 | 9/2008 | Schwelling et al. | |
| 2009/0008871 | A1 | 1/2009 | Omi | |
| 2011/0056952 | A1 | 3/2011 | Borowski et al. | |
| 2011/0165035 | A1 | 7/2011 | Lewis et al. | |
| 2011/0204168 | A1 | 8/2011 | Su | |

FOREIGN PATENT DOCUMENTS

| | | | |
|---|---|---|---|
| CN | 201231172 | Y | 5/2009 |
| CN | 201470445 | U1 | 5/2010 |
| CN | 201735438 | U1 | 2/2011 |
| DE | 32 19 693 | A1 | 12/1983 |
| DE | 3215380 | C2 | 8/1993 |
| DE | 9400310 | U1 | 5/1994 |
| DE | 3814424 | A1 | 11/1999 |
| EP | 0281136 | B1 | 9/1988 |
| WO | 2008095693 | A1 | 8/2008 |
| WO | 2009017885 | A1 | 2/2009 |
| WO | 2009035178 | A1 | 3/2009 |

OTHER PUBLICATIONS

Written Opinion of the International Searching Authority (Form PCT/ISA/237) dated Dec. 4, 2013, for International Application No. PCT/US2013/062266 (five pages).

International Preliminary Report on Patentability for PCT International Patent Application No. PCT/US2008/0665311, mailed Mar. 31, 2011, 17 pages.

International Search Report, International Search Report and Written Opinion for PCT International Patent Application No. PCT/US2008/0665311, Oct. 22, 2009, 17 pages.

Rexel SHRD UK/EU REXEL AUTO+ C/C shredder product description and datasheet from Rexel website, obtained from <url: http://www.rexeleurope.com/rexel/en/gb/p/217/2101998/shrd+uk-eu+rexel+auto%2b+c-c.aspx> (2 pages).

International Search Report and Written Opinion issued on Jul. 16, 2014 in International Application No. PCT/2014US/014667.

German Office Action for German Application No. 11200800184035 dated Aug. 7, 2012, 7 pages.

Great Britain Examination Report for Great Britain Application No. GB1000398.6 dated Jul. 27, 2011, 5 pages.

Great Britain Examination Report for Great Britain Application No. GB1115499.4 dated Jan. 9, 2012, 4 pages.

Chinese Office Action for Chinese Application No. 201110278800.6 dated May 22, 2013, 10 pages.

International Preliminary Report on Patentability issued Apr. 21, 2015 in International Application PCT/US2013/062266.

* cited by examiner

DETAIL B

DETAIL A

SHREDDER AUTO FEED SYSTEM WITH PAPER STACK SEPARATION MECHANISM

BACKGROUND

1. Field

The present disclosure is generally related to an apparatus having cutter elements for destroying documents such as paper sheets. In particular, the apparatus comprises a mechanism for separating and for advancing at least one sheet from a stack of paper in a tray into the cutter elements for shredding.

2. Background

A common type of shredder has a shredder mechanism contained within a housing that is mounted atop a container. The shredder mechanism typically includes a series of cutter elements that shred articles such as paper that are fed therein and discharge the shredded articles downwardly into the container. An example of such a shredder may be found, for example, in U.S. Pat. No. 7,040,559.

Prior art shredders have a predetermined amount of capacity or amount of paper that can be shredded in one pass between the cutter elements. Typically, the sheets of paper are fed into the shredder mechanism manually. Thus, when an operator needs to shred, he or she can only shred a number of sheets of paper by manually inserting one or more sheets one pass at a time. Examples of such shredders are shown in U.S. Pat. Nos. 4,192,467, 4,231,530, 4,232,860, 4,821,967, 4,986,481, 5,188,301, 5,261,614, 5,362,002, 5,662,280, 5,772,129, 5,884,855, and 6,390,397 B1 and U.S. Patent Application Publications 2005/0274836 A1, 2006/0179987 A1, 2006/0179987 A1, and 2006/0249609 A1, which are hereby incorporated by reference in their entirety.

With manual feed shredders, the user would have to spend time feeding smaller portions of the stack manually, thus taking away from productivity time. Other shredders are designed for automatic feeding. The shredder will include a bin in which a state of documents can be placed. A feeding mechanism can then feed the documents from the stack into the shredding mechanism. This type of shredder is desirable in an office setting for productivity reasons, as the user can leave the stack in the bin and leave the shredder to do its work. For example, U.S. Pat. Nos. 4,815,699, 5,009,410, 7,500,627 B2, 7,828,235 B2, and U.S. Patent Application Publication 2009/0008871 A1 and foreign Publications WO 2008/095693 A1 and WO 2009/035178 A1, each of which are hereby incorporated by reference in their entirety, describe shredders with such feed mechanisms. A shredding device that can penetrate and effectively separate paper from a stack without causing damage to the cutters or stopping the machine is desirable.

SUMMARY

One aspect of the disclosure provides a shredder having: a housing; a paper shredder mechanism received in the housing and including a motor and cutter elements, the motor rotating the cutter elements in an interleaving relationship for shredding paper sheets fed therein; a tray for holding a stack of paper sheets to be fed into the cutter elements; a paper stack separation mechanism positioned adjacent to the tray, the paper stack separation mechanism being moveable between a retracted position away from the stack and an extended position for insertion into at least part of the stack to separate at least an edge of at least one paper sheet therefrom; a paper feed mechanism positioned adjacent to the tray for advancing the at least one separated paper sheet into the cutter elements, and a drive system constructed to drive the paper feed mechanism in a feeding direction to feed the at least one separated paper sheet from the stack by the paper stack separation mechanism to the cutter elements.

Another aspect of the disclosure provides a method for advancing paper sheets into cutter elements for shredding. The method includes:

providing a tray for holding a stack of paper sheets;

providing a paper stack separation mechanism to separate one or more paper sheets from the stack;

providing a paper feed mechanism to advance separated paper sheets into the cutter elements;

rotating cutter elements in an interleaving relationship for shredding paper sheets fed therein;

moving the paper stack separation mechanism for insertion into the stack to separate one or more paper sheets for feeding into the cutter elements, and driving the feed mechanism in a feeding direction to feed separated paper to the cutter elements.

Other features and advantages of the present disclosure will become apparent from the following detailed description, the accompanying drawings, and the appended claims.

DETAILED DESCRIPTION OF THE PREFERRED EMBODIMENT(S) OF THE DISCLOSURE

The present disclosure is generally related to an apparatus having cutter elements for destroying articles such as paper sheets, a paper stack separation mechanism for penetrating, separating, and in some cases picking at least one sheet to be shredded from a stack of paper on a tray, and a paper feed mechanism for advancing the at least one sheet separated by the paper stack separation mechanism into the cutter elements for shredding.

It should be noted that while this disclosure references separating sheet(s) and, in some cases, picking paper sheets from a stack, the embodiments of the shredders described herein are also configured to separate and/or pick and shred sheets of any size and/or other articles, such as, but not limited to, disks such as CDs or DVDs, credit cards, cardboard, etc. The shredder is designed to automatically separate a smaller portions from the stack (may contain the paper stapled together, junk mails, CDs and credit cards) and feed them into the shredding mechanism. The stack can include numerous types, sizes, construction, and shapes of articles for shredding (e.g., white paper, letter size, A4, envelopes, etc.) and is not intended to be limited only to picking and shredding paper sheets of any standard or non-standard size.

Figure 1:
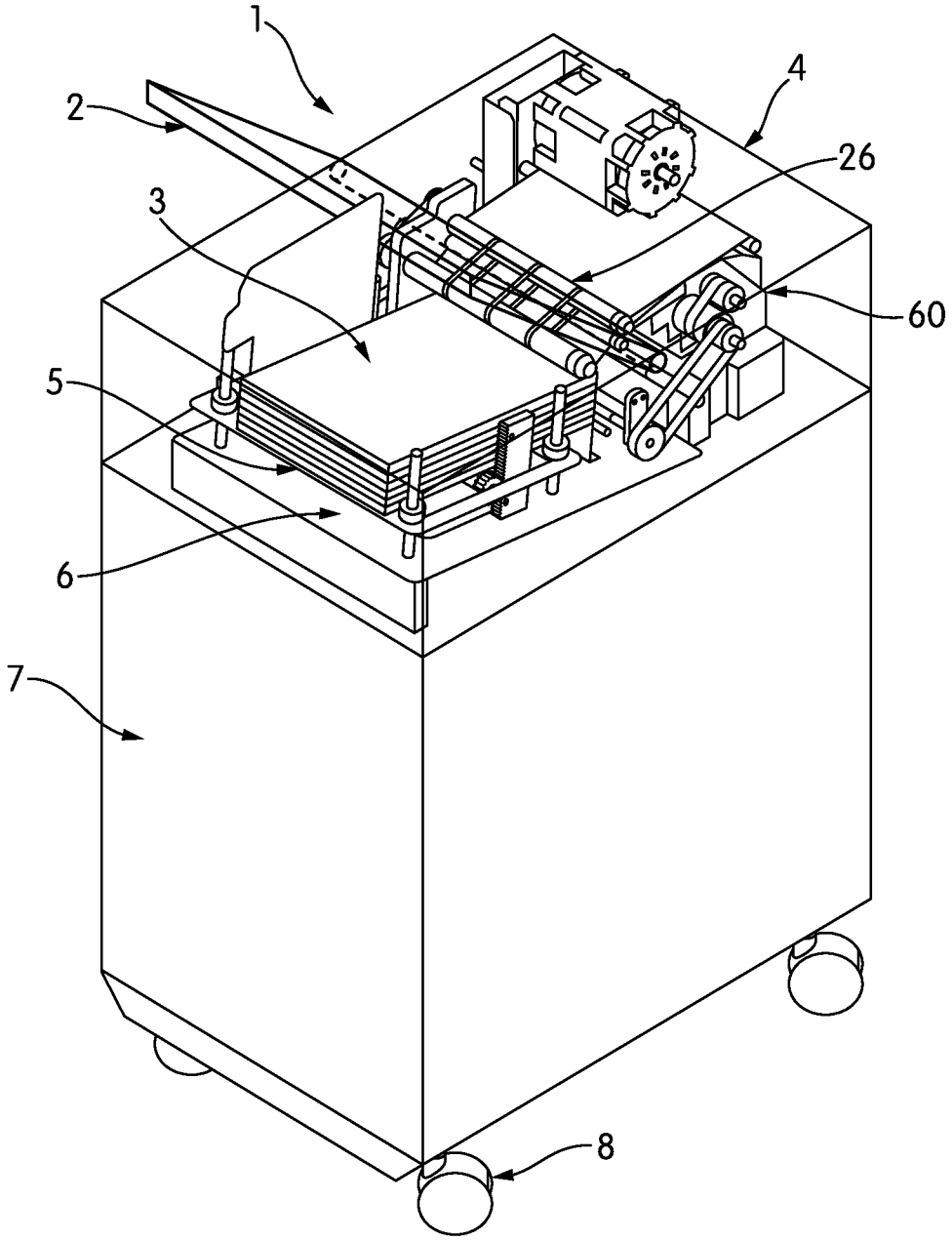
FIG. 1 is a perspective view of a shredder according to an embodiment of the present disclosure.
Figure 2:
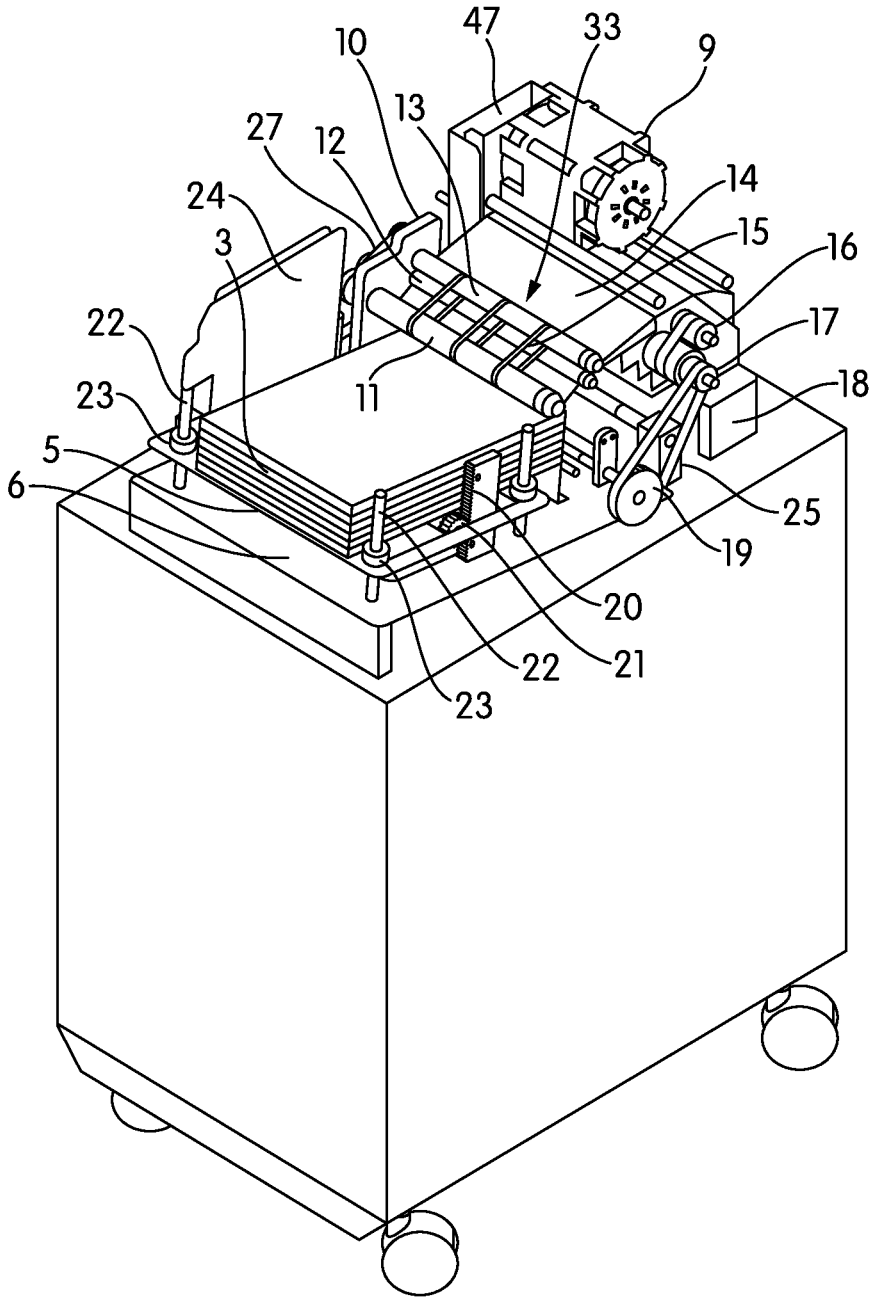
FIG. 2 is a perspective view of the shredder of FIG. 1 without a top cover and a lid.

FIGS. 1 and 2 show a perspective view of a shredder according to an embodiment of the present disclosure. The shredder 1 is designed to destroy or shred articles such as paper. The shredder 1 comprises a housing 4 that on top of a container 7, for example. The container 7 receives paper that is shredded by the shredder 1. The container may be a waste bin itself, or may also be used to house a separate and removable waste bin, for example. In an embodiment, the shredder 1 comprises wheels 8 to assist in moving the shredder 1.

Generally speaking, the shredder 1 may have any suitable construction or configuration and the illustrated embodiment is not intended to be limiting in any way.

The shredder 1 comprises a paper shredder mechanism 60 (sometimes referred to as a cutting block) in the housing 4, and includes a drive system with at least one motor 9, such as an electrically powered motor, and a plurality of cutter elements 36. The cutter elements are mounted on a pair of the parallel mounting shafts 16 and 17. The motor operates using electrical power to rotatably drive rotatable shafts 16 and 17 of the shredder mechanism 60 and their corresponding the cutter elements 36 through a conventional transmission so that the cutter elements 36 shred or destroy articles fed therein. The shredder mechanism 60 may also include a subframe 47 for mounting the shafts and transmission. The shredder mechanism 60 may be positioned adjacent to or below a source of paper (e.g., from a tray 5). The plurality of cutter elements 36 are mounted on the rotatable shafts 16 and 17 in any suitable manners and are rotated in an interleaving relationship for shredding paper sheets fed therein. An exit outlet path 18 and other parts may be provided in the housing 4 as well. The operation and construction of such a shredder mechanism is well known and need not be discussed herein in detail.

The housing 4 is provided with a lid 2. The lid 2 may be pivoted upon one or more hinges 26 between open and closed positions, e.g., using a transmission device (not shown), or by manual force, to allow user access to a tray 5 or feed bed, such as for filling the tray 5 with the paper to be shredded (shown in detail in FIGS. 3 and 4). The tray 5 is designed to hold a stack 3 of paper sheets and/or articles therein that are to be shredded.

In an embodiment, the lid 2 may comprise a safety switch and/or sensor(s). The safety switch and/or sensor(s) may be used to detect if the lid is pivoted to an open position. In an embodiment, when the lid 2 is lifted to an open position, parts of the shredder 1 such as the shredder mechanism and drive system are deactivated such that paper may be inserted onto the tray. The parts can be activated when the lid 2 is in the closed position. The lid 2 may also comprise a locking mechanism that prevents a user from opening the lid or accessing the tray, which may not be desirable while the shredder is in use. In an embodiment, lid 2 may comprise an opening (not shown) for allowing insertion of paper sheets into the tray 5.

Figure 3:
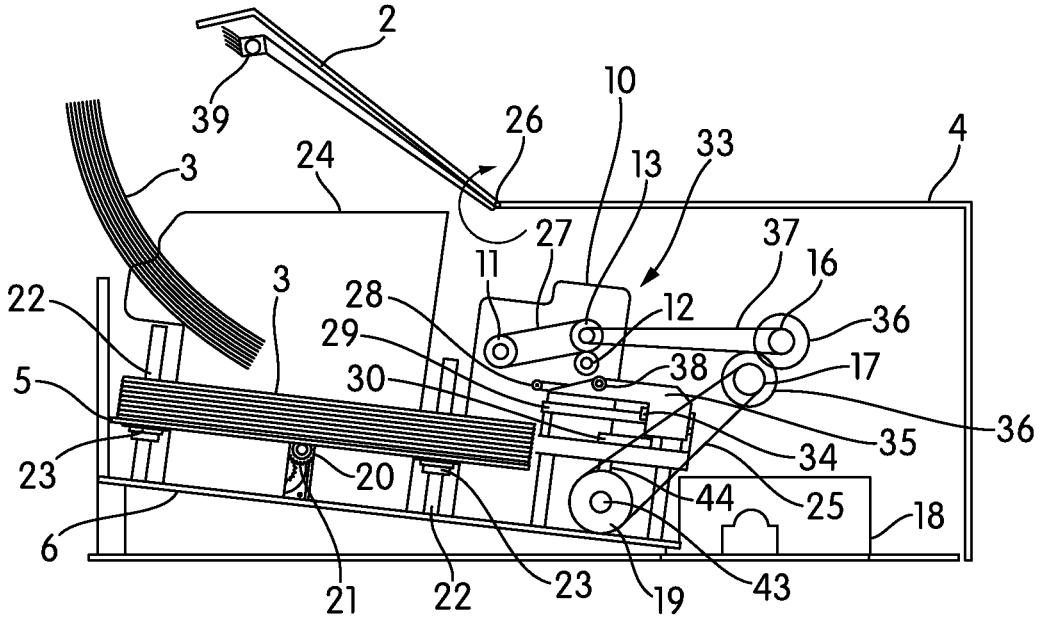
FIG. 3 is a detailed side view of the shredder of FIG. 1.
Figure 4:
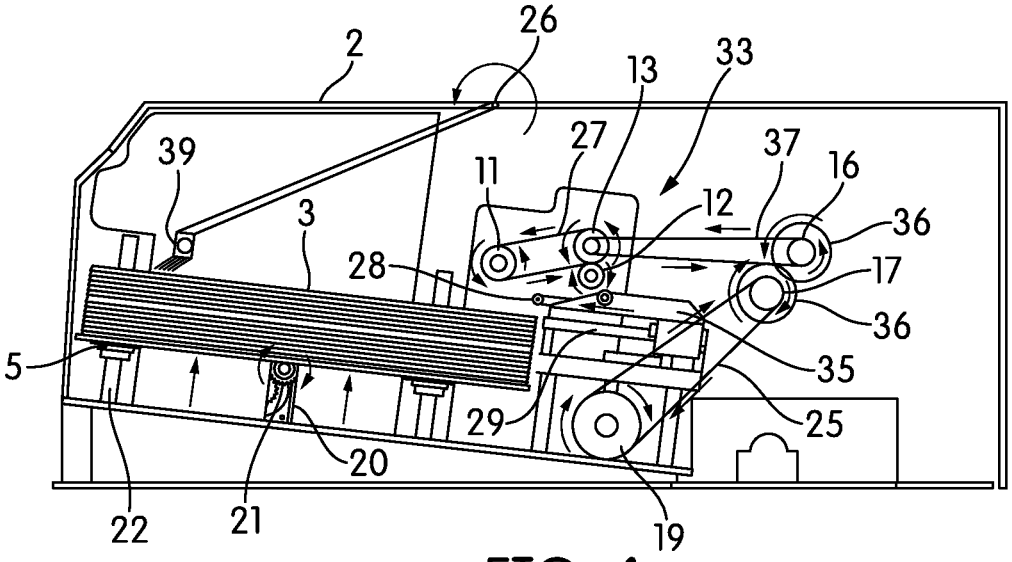
FIG. 4 is the side view of the transmission-relations between the devices in FIG. 3 according to an embodiment of the present disclosure.
Figure 19:
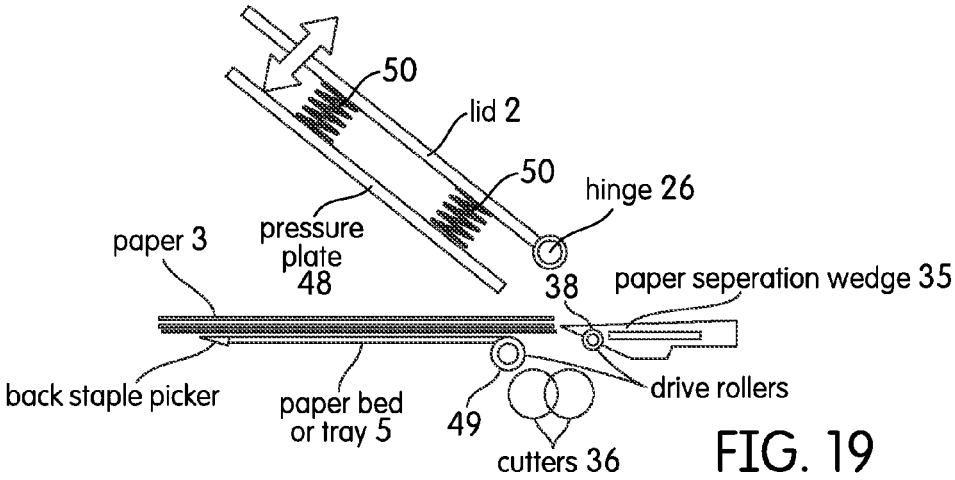
FIG. 19 is a side view of an alternate paper stack separation mechanism and pressure plate in a shredder according to another embodiment of the present disclosure.
Figure 20A:
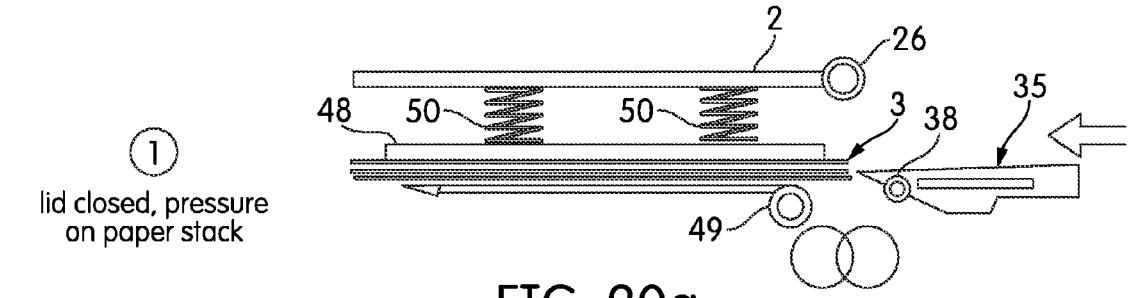
FIGS. 20*a*-20*c* illustrate use of the paper stack separation mechanism and pressure plate of FIG. 19 according to an embodiment.
Figure 20B:
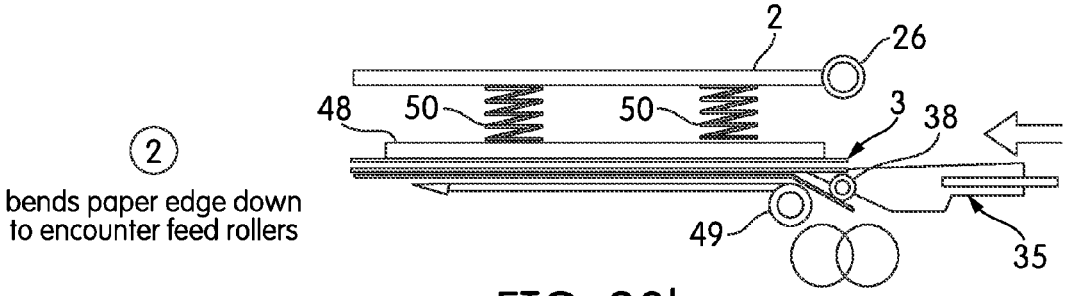
Figure 20C:
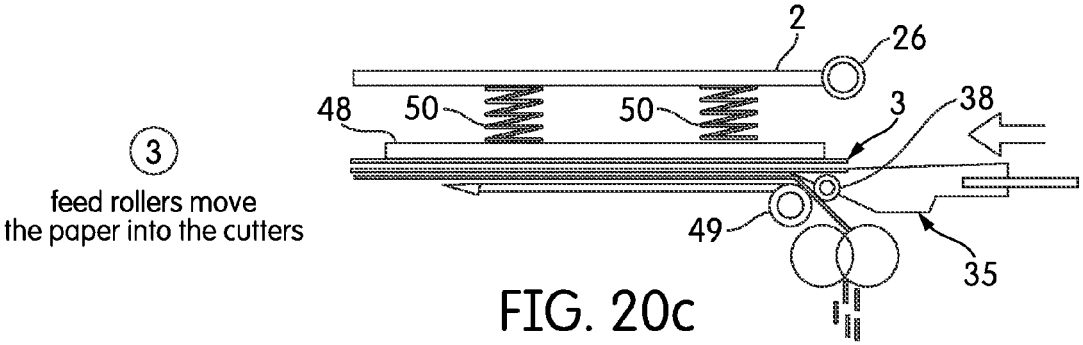

The shredder 1 may also comprise a stripper device 39 for stripping paper sheets from staples. Some examples are shown in FIGS. 3-4 and 17*a*-17*h*. The stripper device 39 is a device for removing to stripping paper sheets that are stapled or bound together in the stack 3 as the sheet(s) are fed to the shredder mechanism. It can have any number of configurations. FIGS. 19-20*c* describe another embodiment of a stripper device. In one embodiment, the stripper device 39 is mounted on or attached to the lid 2. The stripper device 39 may be designed such that it is adjacent to the stack and in front of the paper feed mechanism 33. When the lid 2 is in the open position, the stripper device 39 is automatically hidden under the lid 2, as shown in FIG. 3, so it is convenient for the user to put the paper on the stack 3 into the tray 5. When the lid 2 is in the closed position, the stripper device 39 can touch or engage paper of the stack 3, as shown in FIG. 4, for example. In another embodiment, the stripper device 39 is attached to tray 5 (i.e., below the stack). For example, although not shown, a stripper device may be configured and/or attached below tray 5 in FIG. 19.

The device 39 is used to strip paper sheets that are stapled together in the stack 3 from a staple as the paper sheets are fed to the cutter elements 36 of the shredder mechanism 60. In an embodiment, the device 39 has an extended surface, edge or lip that extends into the path of which stapled sheets or documents are drawn. As a sheet(s) of a stapled document is grasped by the paper feed mechanism 33 (via application of pressure to the sheet(s)), the extended surface intercedes by holding or providing resistance to at least the edge (e.g., near the staple) of the stapled documents (see, e.g., FIG. 17*d* or FIG. 19). Thus, the device 39 can cooperatively provide resistance to at least an edge of the document allowing for the paper sheet(s) to be stripped from the stapled edge. Optionally, an edge of a paper stack separation mechanism 35 (described later) can provide enough resistance or pressure during operation to allow a sheet to be torn from the stapled documents (see, e.g., FIG. 18*c*). As each sheet is grasped and fed toward the shredder mechanism 60 by the paper feed mechanism 33, the sheet is removed from the remainder of the stapled document, which is contacting the stripper device 39. The orientation of the sheets may be such that stapled documents/sheets are placed in the tray 5 with the direction of the staples being adjacent the feed mechanism 33 and/or behind the feed mechanism (e.g., toward the opening of the lid). Despite the orientation of the staples, the devices described herein can provide resistance to at least the picked sheet(s) being fed into the cutter elements 36.

Shredder 1 can also include guide plates 14 and 40 within its housing to help guide and feed paper into cutter elements 36.

Figure 21:
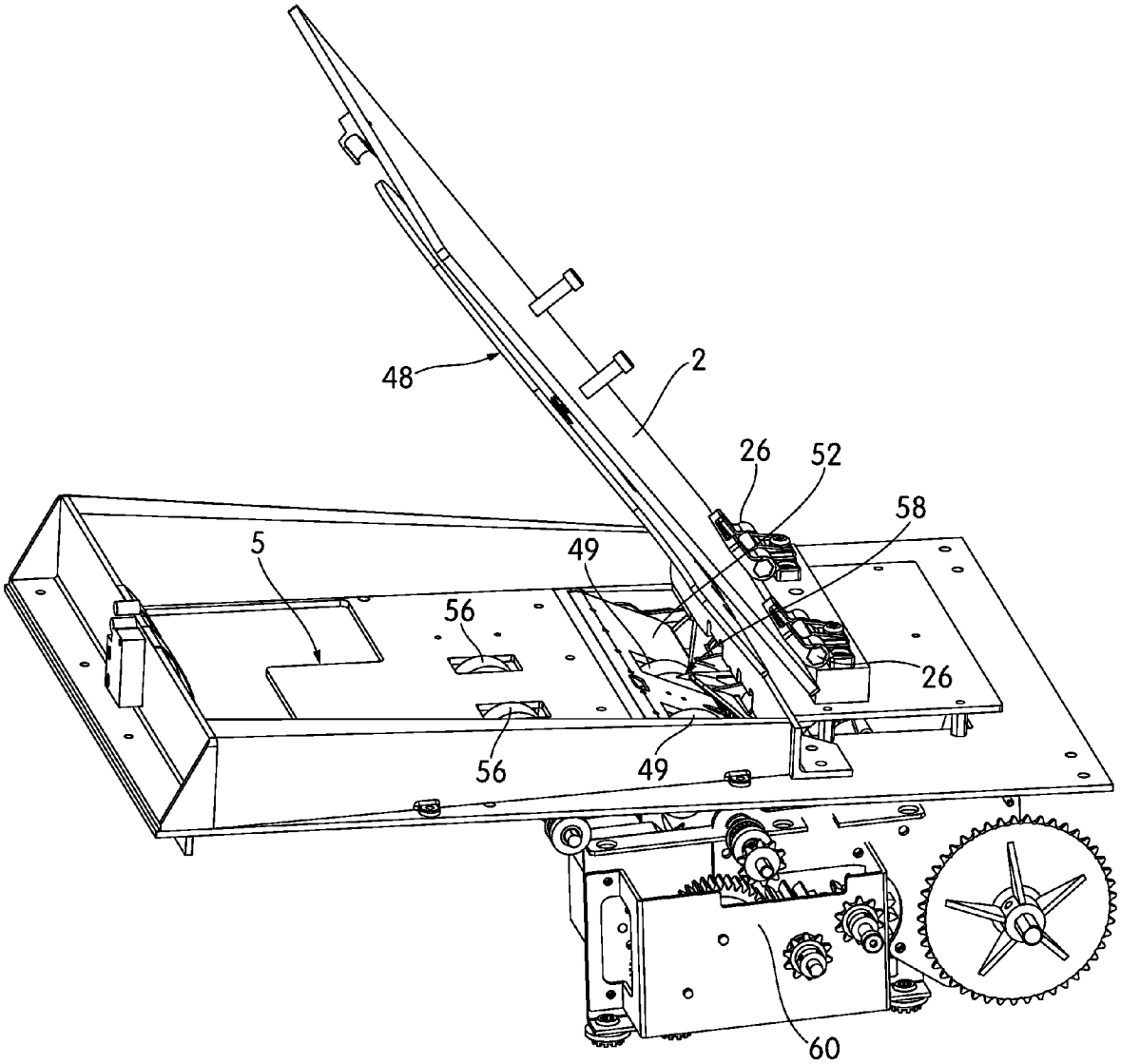
FIG. 21 illustrates an alternate embodiment of a paper stack separation mechanism in accordance with another embodiment.

The tray 5 is mounted such that the paper may be fed from its bed and into the cutter elements 36 of the shredder mechanism 60. For example, the tray 5 and a paper stack separation mechanism 35 may be mounted in line such that the paper stack separation mechanism 35 can move parallel to the tray 5 when at least separating paper from the stack 3. In an embodiment, such as shown in FIG. 21, for example, one or more feed drive rollers 56 may be optionally provided in tray 5 to assist in moving paper therefrom. In another embodiment, the tray 5 is provided at an angle relative to housing 4, such as via a sloped chassis 6. In an embodiment, tray 5 is configured for movement between a lowered position and a raised position within housing 4 and relative to paper stack separation mechanism 35.

Figure 5A:
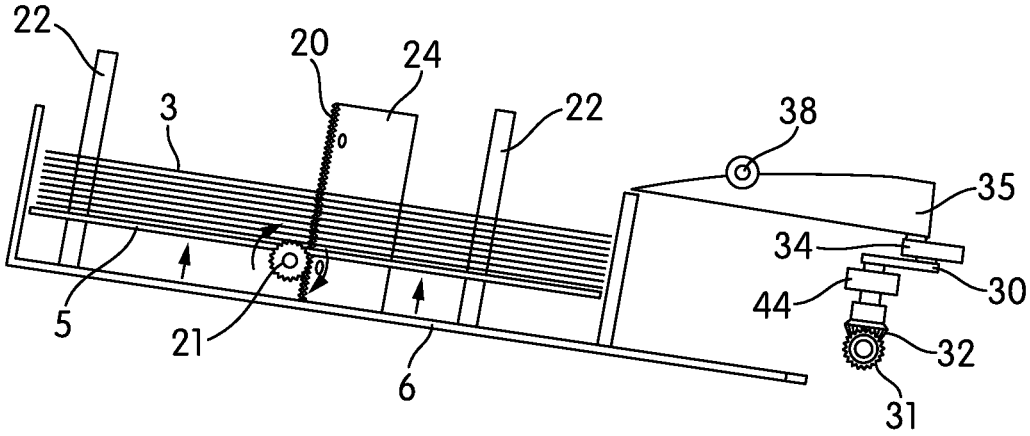
FIGS. 5*a*-5*b* show side views of the movable tray of the shredder of FIG. 1.
Figure 5B:
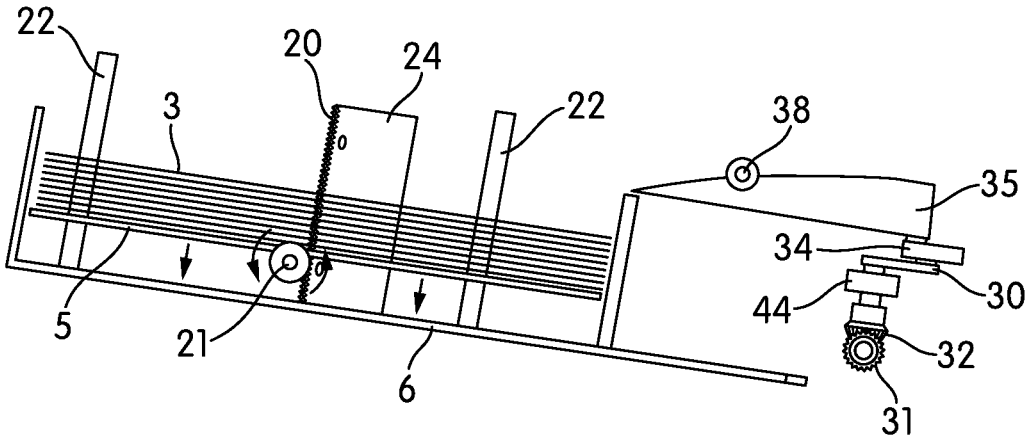

FIGS. 5*a* and 5*b* show one embodiment where the sloped chassis 6 can act as a base for mounting guide posts 22 that can guide the tray 5 move along the guide posts 22. As shown in greater detail in FIG. 2, for example, four axle sleeves 23 are mounted on four corners of the tray 5. The axle sleeves 23 on the tray 5 are also mounted on the four guide posts 22 which are mounted vertically on the chassis 6, so the tray 5 can be reciprocated along the guide posts 22. A rotatable transmission gear 21 is mounted on the base of the tray 5. The rotatable transmission gear 21 meshes with a gear rack 20 mounted on the chassis 6 via wall 24, so that the tray 5 can be moved vertically along guide posts 22. The transmission gear 21 can be revolved through a stepping motor (not shown) or drive system, and is constructed to move the tray to its raised position to feed paper from the stack 3 to the cutter elements, and lower the tray, as needed (e.g., when adding more paper to the tray 5). Changing the direction of rotation of the stepping motor (not shown) or drive system for driving transmission gear 21 changes the direction of the rotation of the transmission gear 21. Accordingly, the stack 3 on the tray can be moved based on the movement of the transmission gear 21. In an embodiment, a controller or similar device can be used to control the speed and the direction of the stepping motor/system for driving the tray 5 with the stack of the paper thereon vertically up and down, and/or at a predetermined speed.

In one embodiment, tray 5 is configured for movement relative to movement of lid 2. For example, when lid 2 is pivoted open about it hinge(s) 26, the tray 5 may be moved vertically downward along guide posts 22 and away from the lid 2. This allows for additional articles or paper to be added onto the tray. In an embodiment, after the lid 2 is closed, the tray 5 is configured to move vertically upwardly towards lid 2. That is, the tray 5 can move along guide posts 22 to a height such that the paper stack separation mechanism 35 can penetrate, separate, and assist in advancing paper from the stack on tray 5 to the cutters. Accordingly, one or more height sensors may be provided within the housing 4 to detect either the height of the stack, the tray, or both, so that tray 5 can be moved to a height such that the stack is penetrable by the paper stack separation mechanism 35. In one embodiment, noted further below, a sensor 28 is provided to detect a height of the stack. In an embodiment, the stack 3 on the tray 5 is raised until a top surface of the stack 3 on the tray 5 is N paper sheets higher (or a certain distance measured in units of distance, e.g., inches, millimeters, or fractions of an inch) than a front end of the paper stack separation mechanism 35. Moreover, in an embodiment, such sensor(s) are used to maintain the height of the tray 5, and thus the stack, as the stack height is reduced during the advancing and shredding processes. The sensors can be used to hold the tray at a height so that the tray is aligned for picking last sheets of a stack.

In one embodiment, the stack 3 on the tray 5 is configured for movement vertically in an upward direction. For example, a top surface of the stack 3 on the tray 5 may be positioned relative to the paper stack separation mechanism 35.

In another embodiment, sloped chassis 6 is not provided and tray 5 is not angled within housing 4 (e.g., see FIG. 19). Tray 5 can be generally horizontally positioned, for example. Also, tray 5 need not move relative to housing 4. In an embodiment, a pressure plate 48 is mounted within housing 4 for movement relative to the stack 3 of paper sheets in or on the tray 5. Pressure plate 48 is configured to apply pressure to at least a top sheet of the stack 3, for example, as shown in FIGS. 20*a*-20*c*. Pressure plate 48 can be mounted to lid 2 via resilient devices 50, such as springs. Pressure plate 48 can assist by assuring that a thickness of the sheets or articles picked up by the paper stack separation mechanism (N sheets) is substantially accurate. When the lid 2 is in the open position, the pressure plate 48 moves with the lid 2 and is automatically positioned under and adjacent to the lid 2, as shown in FIG. 19, so it is convenient for the user to put the paper on the stack 3 into the tray 5. When the lid 2 is in the closed position, the pressure plate 48 can touch or engage paper of the stack 3, as shown in FIG. 20*a*, for example.

As previously mentioned, shredder 1 includes a paper stack separation mechanism 35 for penetrating, separating, and in some cases picking at least one sheet to be shredded from a stack of paper on a tray, and a paper feed mechanism 33 for advancing the at least one sheet separated (and picked) by the paper stack separation mechanism 35 into the cutter elements for shredding. Paper stack separation mechanism 35 is configured to engage with and to be inserted at least partially into the stack so that it penetrates at least a portion of the stack of articles (and/or paper) at an end proximal to the paper feed mechanism 33. It can separate at least an edge of at least one sheet from the stack. It can apply pressure to split or pick the portion of the stack. Accordingly, throughout this disclosure, it should be understood that reference to "picking" paper or articles using paper stack separation mechanism 35 refers to the mechanism 35 being inserted into at least part of the stack in order to separate at least a portion (e.g., edge) of paper/articles from the stack 3.

As can be seen in FIG. 3, for example, in one embodiment, the paper feed mechanism 33 is positioned adjacent to tray 5 and is used to advance paper into the cutter elements 36. More specifically, the paper feed mechanism 33 is positioned above the tray 5. The paper feed mechanism 33 contains four rotatable feed rollers 11, 12, 13, and 38 and a drive system that is driven by rotation of the cutter elements 36 (more specifically, by rotation of their shafts 16 and 17). The drive system is constructed to drive the paper feed mechanism 33 in a feeding direction to feed paper picked from the stack by the paper stack separation mechanism to the shredder mechanism 60. The feed rollers 11, 12, and 13 are mounted on a sub-frame 10. The feed roller 38 is mounted on the paper stack separation mechanism 35. The motor 9 operates to rotatably drive the rotatable shafts 16 and 17 of the shredder mechanism 60 through the transmission, which in turn activates the paper feed mechanism 33 and paper stack separation mechanism 35 through chains and/or belts (or other flexible elements) 25, 27, and 37 connected thereto. The paper feed mechanism 33 includes a feed belt 27 or chain. The feed belt 27 is mounted on two parallel axles and configured for rotation about its axles by rotation of the cutter elements on their shafts 16 and 17, so that rotation of the feed belt 27 feeds the paper picked by the paper stack separation mechanism 35 to the cutter elements 36. In the illustrated embodiment, feed belt 27 is mounted on axles including feed rollers 11 and 13.

An activation belt 37 is also mounted on two parallel axles, one of the axles being associated with the rotatable shafts 16, 17 of the cutter elements 36 (in this illustrated case, shaft 16) and the other of the axles being associated with feed belt 27 of the paper feed mechanism 33 (e.g., feed roller 13). Rotation of the axle associated with the cutter elements rotates the activation belt 37, which, in turn, rotates the axles associated with the feed belt 27 of the paper feed mechanism 33. Thus, the feed belt 27 is rotated about its axles and driven to advance paper towards and into cutter elements 36. That is, as the shaft 16 is rotated, then, the chain or activation belt 37 drives the feed roller 13 to revolve, which drives the feed belt 27 and feed roller 11 to revolve.

Feed roller 12 of paper feed mechanism is designed to cooperate with feed belt 27 to advance paper towards the cutter elements 36 of the shredder mechanism 60. Specifically, rotation of feed roller 13 drives rotatable feed roller 12 (through contact with belt 27) to revolve through friction between the feed rollers 13 and 12. As described later, picked paper will be grasped and fed to the cutters via belt 27 and roller 12. Feed roller 38 is mounted on the paper stack separation mechanism 35. Although feed roller 38 is generally idle when disengaged from the stack, it should be understood that feed roller 38 is not only rotatable, but also can be alternated between an idle state and being in motion in accordance with the paper stack separation mechanism 35 as it moves along its slide rail 29 and into the stack, as described below.

Figure 7:
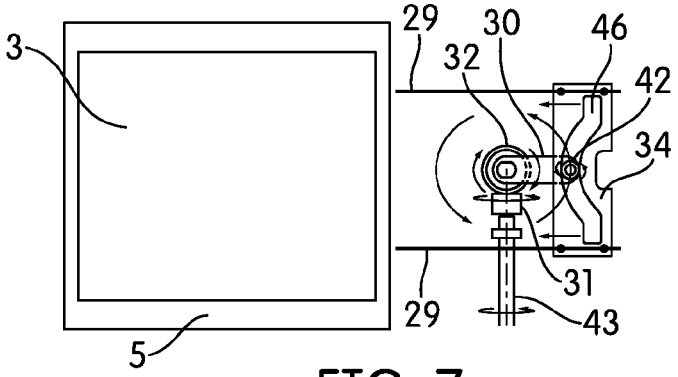

The paper stack separation mechanism 35 is positioned adjacent to tray 5 and is moveable between a retracted position away from the stack 3 and an extended position for engaging and picking paper from at least part of the stack 3. In an embodiment, the paper stack separation mechanism 35 is configured to move parallel to tray 5. The paper stack separation mechanism 35 has a body that can be mounted on or with a slide block 34. The slide block 34 can be mounted on one or more slide rails 29 (two being shown in FIGS. 7 and 9, for example) so that the slide block 34 can be slid or moved along the slide rails 29. The slide block 34 may be formed separately from the body of the paper stack separation mechanism (and attached thereto), or may be integrally formed therewith. A back end of the body of the paper stack separation mechanism 35 may be used for mounting with the slide block 34. However, a slide block 34 need not be used to move body of paper stack separation mechanism 35.

Figure 6:
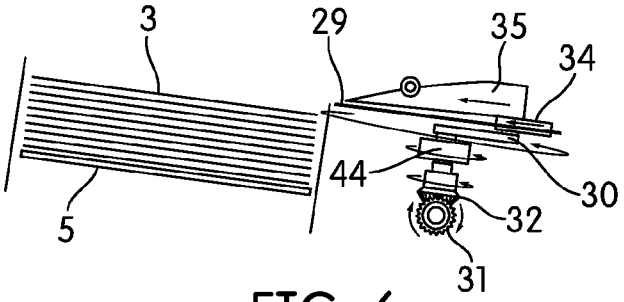
FIGS. 6-15 show side and overhead views of the reciprocating motion of the paper stack separation mechanism according to an embodiment of the present disclosure.

In order to make it easier for the paper stack separation mechanism 35 to be inserted into the stack 3 when in the engaged position, a front end of the body of the paper stack separation mechanism 35 is designed with a picking edge. The picking edge can have a pointed shape. For example, the body can be in the shape of a wedge with a pointed end. In an embodiment, the paper stack separation mechanism 35 has an inclined surface configured to guide picked paper towards the cutter elements of the shredder mechanism. FIGS. 3, 6, and 19 show example shapes of the body of paper stack separation mechanism 35. The front end of paper stack separation mechanism 35 can also include rotatable feed roller 38 mounted thereon which can reciprocate with the paper stack separation mechanism 35. In one embodiment, the rotatable feed roller 38 can be provided on or adjacent to the inclined surface, for example. In an embodiment, feed roller 38 can contact a feed belt 27 and/or assist in grasping picked paper from the stack 3 and feeding it towards the shredder mechanism, as further explained below.

In one embodiment, the paper stack separation mechanism 35 is positioned above the tray.

The drive system is also constructed to move the paper stack separation mechanism 35 in an alternating manner between its retracted and extended positions such that the paper stack separation mechanism 35 alternates between engaging and penetrating the stack to pick or separate paper for feeding to the cutter elements and withdrawing and disengaging from the stack. In one embodiment, the drive system of the paper stack separation mechanism 35 comprises a chain or drive belt 25 mounted on two parallel axles. The drive belt is configured to rotate about its axles by rotation of one of the rotating shafts 16, 17 of the cutter elements 36 (in this illustrated case, shaft 17) so that the rotation of the drive belt 25 moves the paper stack separation mechanism in its alternating manner.

Rotation of the drive belt 25 drives a belt pulley 19 to revolve so that a shaft 43 mounted on or to the belt pulley 19 is also revolved. The shaft 43 drives a transmission so that paper stack separation mechanism 35 can be alternated in its motion along the slide rail 29 towards and away from stack 3 (see. FIG. 3 and FIG. 4). One end of the shaft 43 is connected to the transmission belt pulley 19 and the opposite end of the shaft 43 is connected to a bevel gear 31 (shown in FIGS. 5*a*-5*b*). The bevel gear 31 meshes with another bevel gear 32, which, as shown in FIGS. 5*a* and 5*b*, is at 90 degrees in space, i.e., bevel gear 32 is mounted approximately 90 degrees relative to bevel gear 31 (and rotates in an anti-clockwise direction). Bevel gear 32 is connected to and drives a shaft 44 in an anti-clockwise direction. One end of the shaft 44 is connected to the bevel gear 32 while the opposite end of the shaft 44 is connected to a crank 30. Crank 30 is used to move slide block 34 and thus paper stack separation mechanism 35. Crank 30 is activated via motion of shaft 44. One end of the crank 30 is connected to shaft 44, and the opposite end of the crank 30 is provided with a rotatable axle bearing 42. The movement of the axle bearing 42 results in the alternating rectilinear yet non-undulating motion of the paper stack separation mechanism.

Specifically, as shown in detail in FIGS. 7, 9, 11, 13, and 15, a groove 46 is provided in or on the slide block 34. The groove 46 may be substantially V-shaped or U-shaped, for example. The rotatable axle bearing 42 on crank 30 is mounted in groove 46. As the crank 30 is moved, the axle bearing 42 is revolved around its center (about its axle) and is moved between ends of the groove 46. As the axle bearing 42 moves between the ends of groove 46, the paper stack separation mechanism 35 is moved between its retracted and extended positions. Because the axle bearing 42 is slid in a groove 46 of the slide block 34 having a V-shape (as shown), the paper stack separation mechanism 35 obtains a mechanical delay at a front end and a rear end of the reciprocating movement (due to the direction of the reciprocating movement being changed each time it reaches an end of the groove). So, the paper stack separation mechanism 35 stays for a period of time before the direction of the reciprocating motion is changed. The reciprocating and non-undulating motion of the paper stack separation mechanism 35 is a result of the movement of the axle bearing 42 within the groove 46. The stay or delay in movement for a period of time as the direction of movement of the bearing 42 changes assists in stably picking and feeding paper sheets.

Accordingly, when the transmission belt pulley 19 revolves in a circle about its axle based on movement of drive belt 25, the shaft 43 also revolves a circle about its axle, resulting in bevel gear 31, bevel gear 32, shaft 44 and crank 30 all being revolved about their axles. The crank 30 moves the slide block 34 to reciprocate at a time along the slide rail 29 so that the paper stack separation mechanism 35 mounted on the slide block 34 reciprocates along the slide rails 29.

Figure 8:
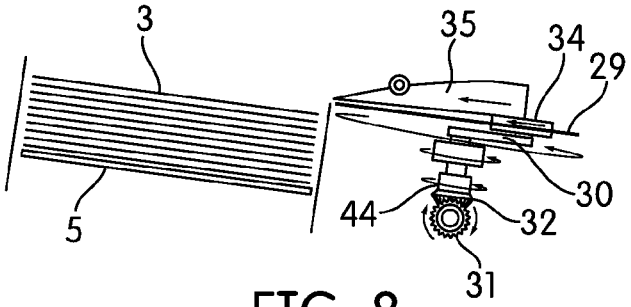
Figure 9:
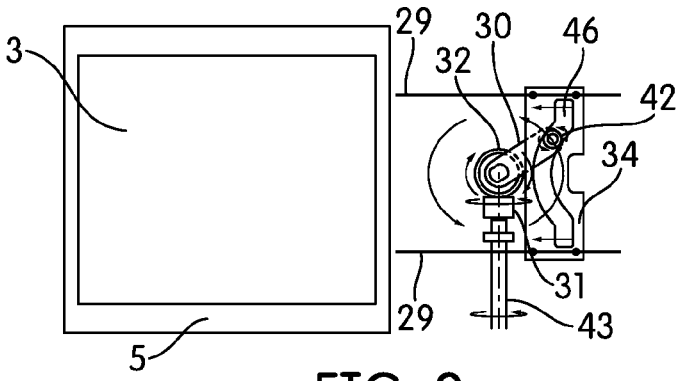
Figure 10:
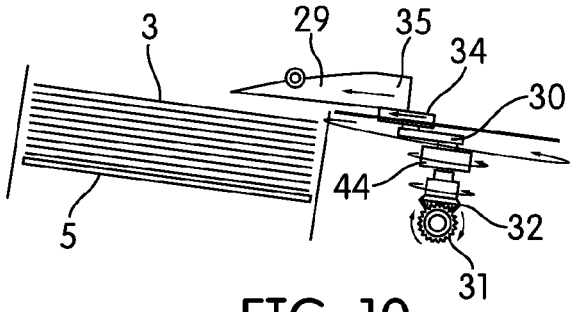

FIGS. 6-15 show side and overhead views of the reciprocating motion of the paper stack separation mechanism 35. The body of the paper stack separation mechanism 35 is not specifically drawn in each of these figures for simplicity purposes only; however, it should be understood that the paper stack separation mechanism 35 is mounted on the slide block 34 and moves with the slide block 34. In FIG. 6, the paper stack separation mechanism 35 is situated at its rear end in a retracted position (e.g., situated at or near the cutter elements 36) (shown in overhead view in FIG. 7). Once electrical power is used to rotate drive rotatable shafts 16 and 17 of the shredder mechanism through a transmission, the rotating shafts 16 and 17 drives the rotatable belt pulley 19 to rotate through the drive belt 25 so that the shaft 43 mounted on the belt pulley 19 can be rotated (FIG. 7 indicates the direction of the rotatable shaft 43). Meanwhile, the bevel gear 31 mounted on the shaft 43 is revolved in the same clockwise rotation direction. The bevel gear 32 is revolved in an anti-clockwise rotation direction (see FIG. 6). As shaft 44 is revolved in the same direction as bevel gear 32, the crank 30 is revolved (in this case, in the same anti-clockwise direction). As shown in FIGS. 8 and 9, the rotating crank 30 tows the slide block 34 through the rotatable axle bearing 42 mounted in the groove 46 on the slide block 34 so that the slide block 34 is moved towards the paper stack 3 (to the left in the FIGS., as indicated by arrows) along the slide rails 29. The axle bearing 42 is revolved around own center, e.g., in an anti-clockwise rotation direction, along its axle and is moved in the groove 46 of the slide block 34 so that its tows the slide block 34 towards the paper stack 3. After the revolving belt pulley 19 has been rotated a predetermined angle, the axle bearing 42 is moved into the end of groove 46 of the slide block 34 (see FIG. 9) and is moved into its extended position into the stack 3 in tray 5 for picking paper (see FIG. 10).

Figure 11:
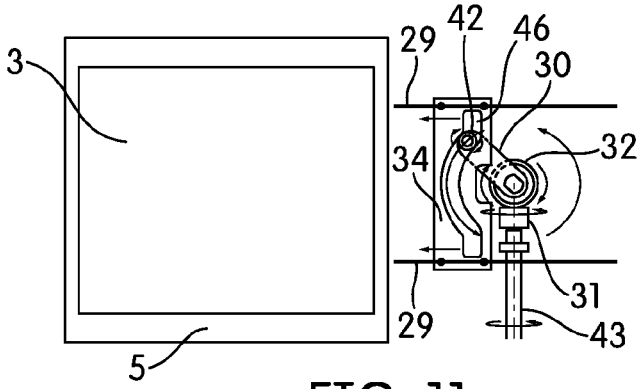
Figure 12:
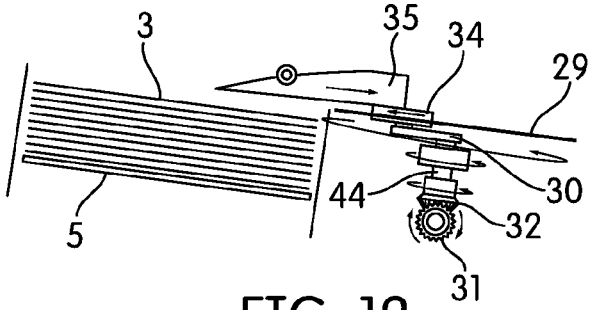
Figure 13:
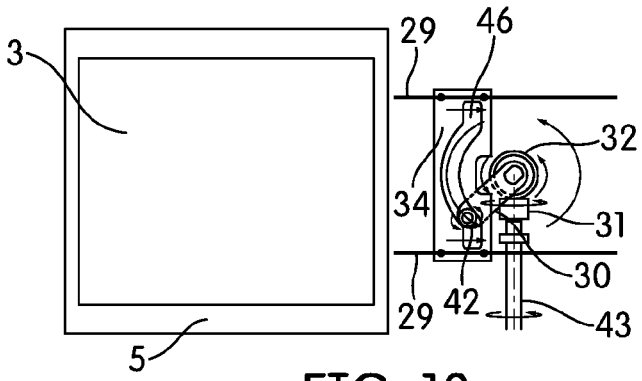
Figure 14:
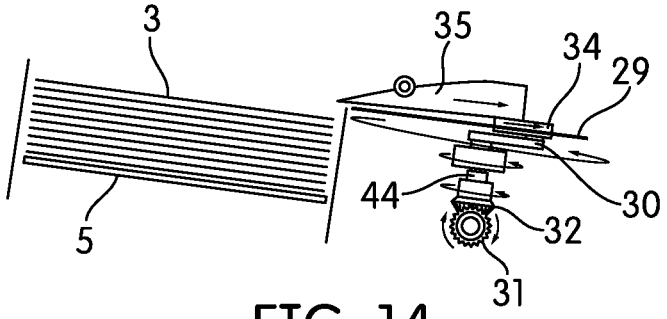
Figure 15:
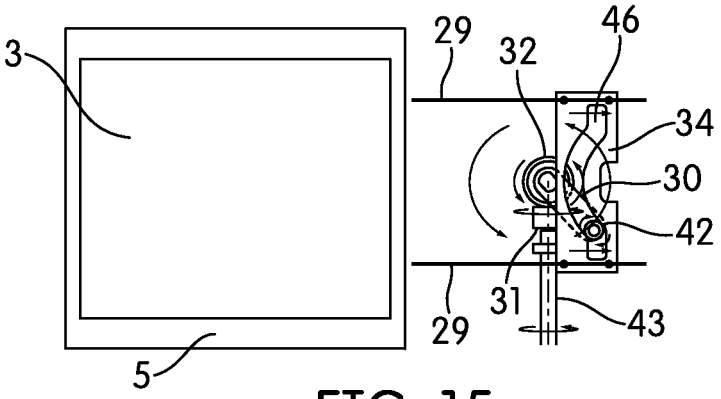

Once it reaches the end of groove 46, axle bearing 42 is moved to another position towards opposite end of groove 46, as shown in FIG. 11. Axle bearing 42 rotates in an opposite direction—in this case, in a clockwise rotation direction—along its axle and is moved in groove 46 of slide block 34 so that the slide block is towed away from the paper stack 3 and in a direction towards the cutter elements 36 (to the right in the FIGS., as indicated by arrows), shown in FIG. 12 and FIG. 13. At the same time, the paper stack separation mechanism 35 is leaving the paper stack 3. In FIGS. 14 and 15, the paper stack separation mechanism 35 has left the stack 3 and axle bearing 42 is moved into the opposite end of groove 46 of the slide block 34 so that the paper stack separation mechanism 35 is in its refracted position. Once it enters into the opposite end of groove 46, axle bearing 42 will again be moved to another position towards the other end of groove 46, rotating axle bearing 42 in the opposite direction (anticlockwise) and moving slide block 34 and thus paper stack separation mechanism 35 back towards the stack 3.

In an embodiment, a sensor 28 is mounted on or near the paper picker mechanism 35 to detect a height of a top surface of paper in the stack 3 on the tray 5 (e.g., see FIG. 3). Sensor 28 can be configured to detect a number N of paper sheets that are provided at a height higher than the pointed front end of the paper stack separation mechanism 35 (N is a predetermined quantity of paper sheets). For example, N can correlate to a predetermined thickness of sheets or articles (resulting from a quantity of sheets) that can be shredded via the cutter elements 36 at a time. Upon detection via the sensor 28 that a top surface of the stack 3 is N sheets paper higher than the pointed front end of the paper stack separation mechanism 35, the sensor 28 is used to trigger activation of the motor 9 such that it is automatically started by a controller and a driving circuit to drive the rotatable shafts 16 and 17 of the shredder mechanism. Accordingly, the paper feed mechanism 33 and paper stack separation mechanism 35 are also activated. Moreover, in an embodiment, the movement of tray 5 can also be coordinated based on the sensor 28 detection.

FIGS. 16*a*-18*g* include descriptions of different embodiments of shredders. It should be noted that, before picking and feeding, and after insertion of the paper sheets in housing 4, the lid 2 is pivoted closed and the shredder mechanism, paper feed mechanism 33, and paper stack separation mechanism 35 of the shredder 1 are activated (e.g., upon closure of the lid, via sensor, or manually) through drive systems and/or transmissions. In an embodiment, the driver system comprises a timer for controlling at least the start time for movement of the paper stack separation mechanism 35 in an alternating manner. In another embodiment, the shredder mechanism is activated upon detection via sensor 28 that a predetermined number N of paper sheets in the stack 3 are adjacent or above the paper stack separation mechanism 35.

Figure 16A:
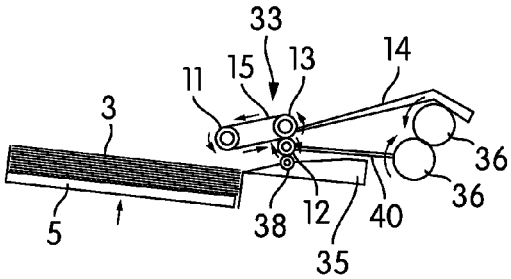
FIGS. 16*a*-16*h* show side views of a shredder according to an embodiment of the present disclosure for automatically picking and feeding paper sheets into the shredder mechanism.
Figure 16E:
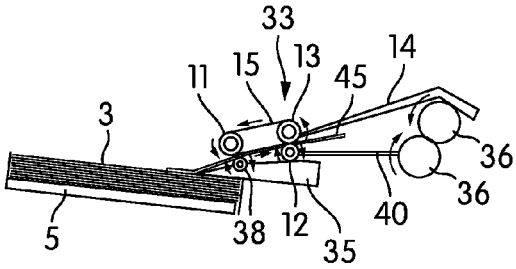
Figure 16B:
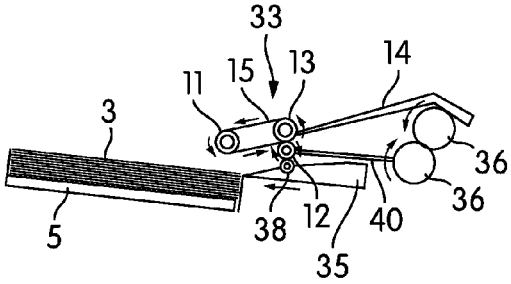

FIGS. 16*a*-16*h* show side views of a shredder for automatically picking and feeding paper sheets into the cutter elements 36 for shredding according to an embodiment of the present disclosure. Once activated, as shown in FIG. 16*a*, tray 5 is moved in an upward direction so that the stack 3 on the tray 5 is raised until a top surface of the stack 3 on the tray 5 is N paper sheets higher than the pointed front end of the paper stack separation mechanism 35. Sensor 28 is triggered by the top surface of the stack 3. Motor 9 is automatically started and drives the feed rollers 11, 13 and the cutter elements 36 to revolve (as previously noted). The rotating feed roller 13 drives the rotatable feed roller 12 to revolve through the friction between the feed rollers 13 and 12. The paper stack separation mechanism 35 is situated at the rear end of the reciprocating motion (near the position of the cutter elements 36) but starts movement towards stack 3 as shown in FIG. 16*b*.

Figure 16F:
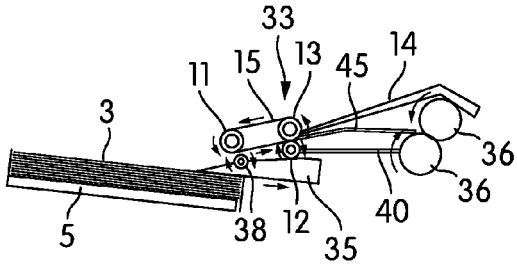
Figure 16C:
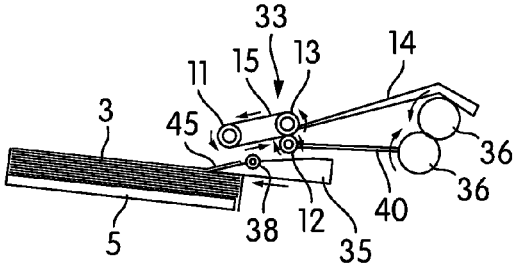

In FIG. 16*c*, the paper stack separation mechanism 35 is inserted into the stack 3 and picks and uplifts the paper 45 (N paper sheets). In FIG. 16*d*, the paper stack separation mechanism 35 is moved to its extended position, and the paper 45 picked and uplifted by the paper stack separation mechanism 35 is squeezed between the feed rollers 11 and 38. The rotating feed roller 11 and the rotatable feed roller 38 together grasp the paper 45 between them and feed it to the direction of near the rollers 12 and 13. Guide plates 14 and 40 are used to help guide and feed the paper 45 into cutter elements 36. The reciprocating motion of the paper stack separation mechanism 35 will obtain a mechanical delay (as previously described), as shown in FIG. 16*e*, so the paper stack separation mechanism 35 will be stopped here for a period of time to wait for the paper 45 to be fed into the cutter elements 36. The rotating feed roller 13 drives the rotatable feed roller 12 to revolve through the friction between them. In FIG. 16*f*, the paper stack separation mechanism 35 is still stopped at the front end (the front end of the reciprocating motion). The rotating feed roller 12 and the rotating feed roller 13 together grasp the paper 45 between them and continuing to feed it into the cutter elements 36. Then, the paper stack separation mechanism 35 prepares to move backward (near the direction of the cutter elements 36).

Figure 16G:
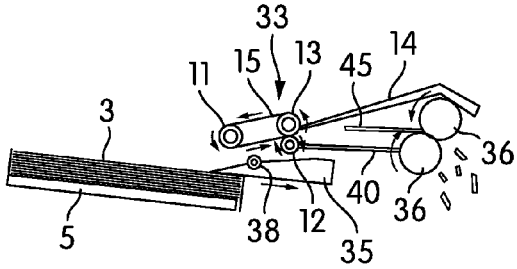
Figure 16D:
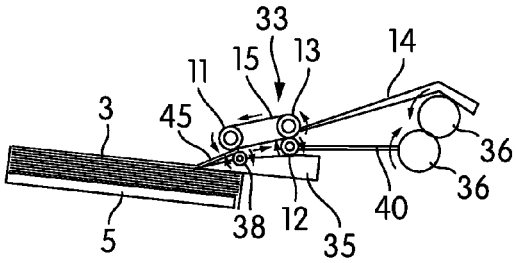
Figure 16H:
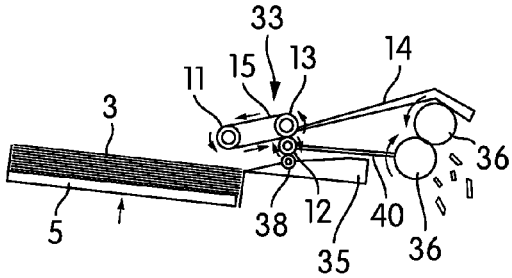

The paper stack separation mechanism 35 is being moved backward (near the direction of the cutter elements 36) in FIG. 16*g*. The rotating cutter elements 36 shreds the paper 45 fed therein as it is also guided by plates 14 and 40. In FIG. 16*h*, the paper stack separation mechanism 35 has been moved to the rear end in a retracted position near the cutter elements 36. Again, the reciprocating motion of the paper stack separation mechanism 35 is in momentary mechanical delay for a period of time. The rollers and belts continue to move and the movement of the paper stack separation mechanism 35 is repeated until all of the sheets of the stack 3 on the tray 5 are shredded.

Figure 17A:
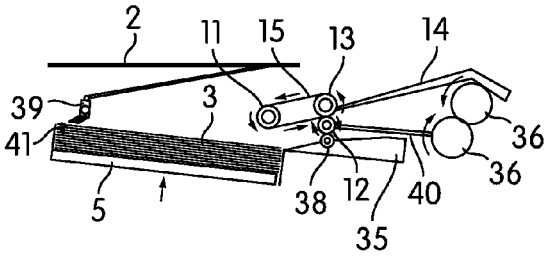
FIGS. 17*a*-17*h* show side views of shredder with a stripper device according to another embodiment of the present disclosure for automatically picking and feeding paper sheets stapled together from a stack and into the shredder mechanism.
Figure 17E:
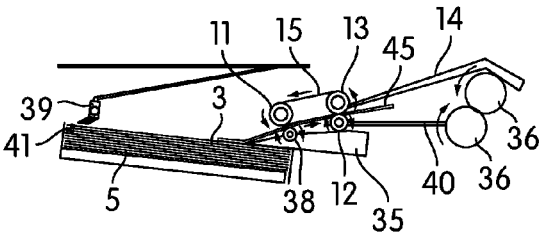
Figure 17B:
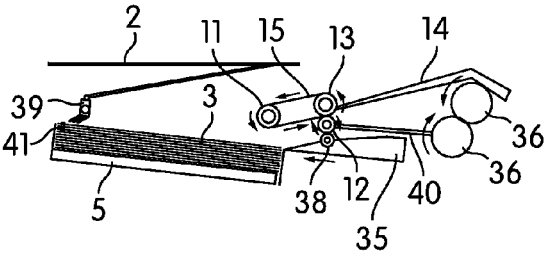

FIGS. 17*a*-17*h* show side views of shredder for automatically picking and feeding the paper sheets stapled together in the paper stack 3 (the staple is in the front end of the tray) into the cutter elements with a stripper device 39 for shredding according to an embodiment of the present disclosure. Papers in the paper stack 3 are stapled together by a staple 41 (the staple 41 is in the front end of the tray 5). Once activated, as shown in FIG. 17*a*, tray 5 is moved in an upward direction so that the stack 3 on the tray 5 is raised until a top surface of the stack 3 on the tray 5 is N paper sheets higher than the pointed front end of the paper stack separation mechanism 35. The stripper device 39 for stripping paper sheets stapled together in the stack 3 touches the paper of the top surface of the paper stack 3. Sensor 28 is triggered by the top surface of the stack 3. Motor 9 is automatically started and drives the feed rollers 11, 13 and the cutter elements 36 to revolve (as previously noted). The rotating feed roller 13 drives the rotatable feed roller 12 to revolve through the friction between the feed rollers 13 and 12. The paper stack separation mechanism 35 is situated at the rear end of the reciprocating motion (near the position of the cutter elements 36) but starts movement towards stack 3 as shown in FIG. 17*b*.

Figure 17F:
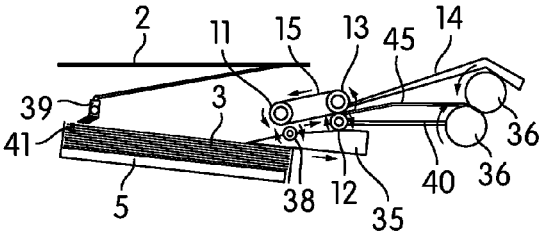
Figure 17C:
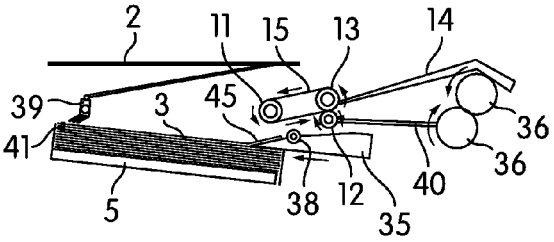

In FIG. 17*c*, the paper stack separation mechanism 35 is inserted into the stack 3 and picks and uplifts the paper 45 (N paper sheets). In FIG. 17*d*, the paper stack separation mechanism 35 is moved to its extended position, and the paper 45 picked and uplifted by the paper stack separation mechanism 35 is squeezed between the feed rollers 11 and 38. The rotating feed roller 11 and the rotatable feed roller 38 together grasp the paper 45 between them and feed it to the direction of near the rollers 12 and 13. The feed rollers 11 and 38 together pull one end of the paper 45, the opposite end of the paper 45 being stapled together by the staple 41. As the one end is pulled, the opposite end that is stapled together will tilt upward. The edge or lip of the stripper device 39 prevents the staple 41 passing with the paper into the cutter elements 36. The staple 41 is separated from the paper 45 by the stripper device 39. Guide plates 14 and 40 are used to help guide and feed the paper 45 into cutter elements 36. The reciprocating motion of the paper stack separation mechanism 35 will obtain a mechanical delay (as previously described), as shown in FIG. 17*e*, so the paper stack separation mechanism 35 will be stopped here for a period of time to wait for the paper 45 to be fed into the cutter elements 36. The rotating feed roller 13 drives the rotatable feed roller 12 to revolve through the friction between them. In FIG. 17*f*, the paper stack separation mechanism 35 is still stopped at the front end (the front end of the reciprocating motion). The rotating feed roller 12 and the rotating feed roller 13 together grasp the paper 45 between them and continuing to feed it into the cutter elements 36. Then, the paper stack separation mechanism 35 prepares to move backward (near the direction of the cutter elements 36).

Figure 17G:
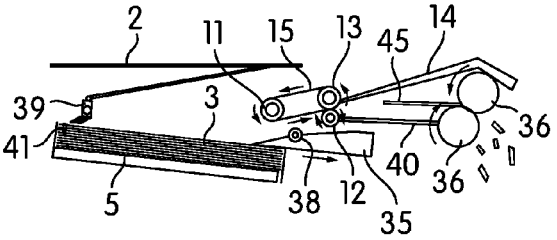
Figure 17D:
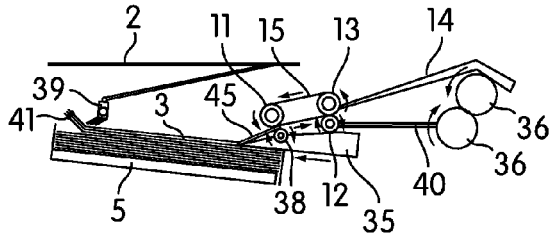
Figure 17H:
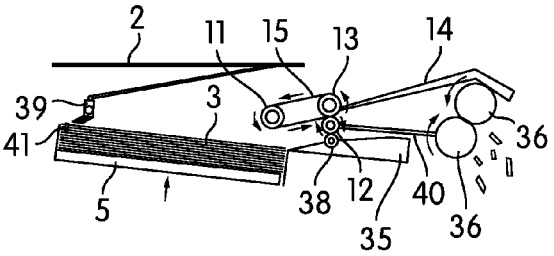

The paper stack separation mechanism 35 is being moved backward (near the direction of the cutter elements 36) in FIG. 17*g*. The rotating cutter elements 36 shreds the paper 45 fed therein as it is also guided by plates 14 and 40. In FIG. 17*h*, the paper stack separation mechanism 35 has been moved to the rear end in a retracted position near the cutter elements 36. Again, the reciprocating motion of the paper stack separation mechanism 35 is in momentary mechanical delay for a period of time. The rollers and belts continue to move and the movement of the paper stack separation mechanism 35 is repeated until all of the sheets of the stack 3 on the tray 5 are shredded.

Figure 18A:
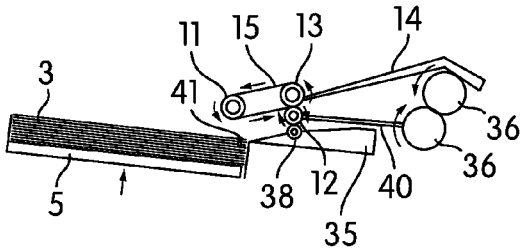
FIGS. 18*a*-18*g* show side views of shredder according to yet another embodiment of the present disclosure for automatically picking and feeding paper sheets stapled together from a stack and into the shredder mechanism.
Figure 18B:
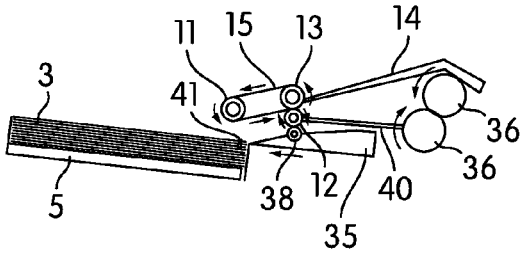

FIGS. 18*a*-18*g* show side views of the shredder for automatically picking and feeding paper from paper sheets stapled together in the paper stack 3 into the cutter elements 36 for shredding, according to an embodiment of the present disclosure. Specifically, the paper stack separation mechanism 35 itself is configured to be a device for stripping paper from a stapled set of sheets. For example, its pointed front end can be used to strip paper from a staple. Papers in the paper stack 3 are stapled together by a staple 41 at one or two corners of the paper sheets of the stack 3. The stapled stack 3 can be inserted into the housing such that the staple 41 is in the rear end of the tray 5, near or adjacent the paper stack separation mechanism 35. Once the shredder is activated, as shown in FIG. 18*a*, tray 5 is moved in an upward direction so that the stack 3 on the tray 5 is raised until a top surface of the stack 3 on the tray 5 is N paper sheets higher than the pointed front end of the paper stack separation mechanism 35. If provided, a stripper device 39 (not shown) for stripping paper sheets stapled together in the stack 3 would be configured to touch the paper of the top surface of the paper stack 3. Sensor 28 is triggered by the top surface of the stack 3. Motor 9 is automatically started and drives the feed rollers 11, 13 and the cutter elements 36 to revolve (as previously noted). The rotating feed roller 13 drives the rotatable feed roller 12 to revolve through the friction between the feed rollers 13 and 12. The paper stack separation mechanism 35 is situated at the rear end of the reciprocating motion (near the position of the cutter elements 36) but starts movement towards stack 3 as shown in FIG. 18*b*.

Figure 18C:
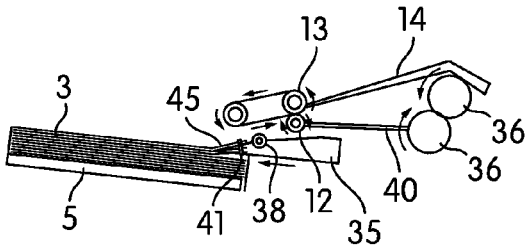
Figure 18D:
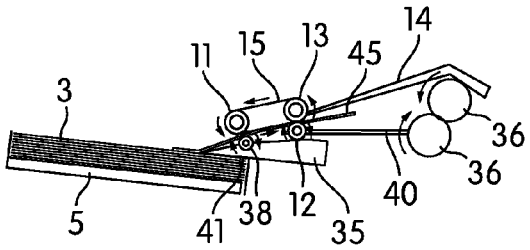
Figure 18E:
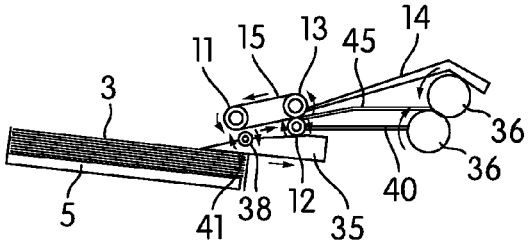
Figure 18F:
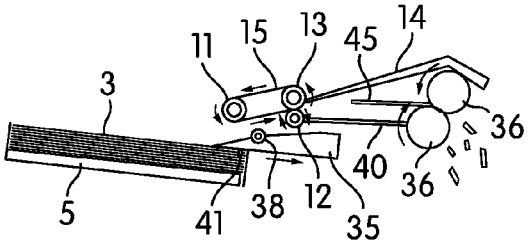

In FIG. 18*c*, the paper stack separation mechanism 35 is inserted into the stack 3 and picks and uplifts the paper 45 (N paper sheets). In FIG. 18*d*, the paper stack separation mechanism 35 is moved to its extended position, and the paper 45 picked and uplifted by the paper stack separation mechanism 35 is squeezed between the feed rollers 11 and 38. The rotating feed roller 11 and the rotatable feed roller 38 together grasp the paper 45 between them and feed it to the direction of near the rollers 12 and 13. The other paper stapled together by the staple 41 are under the paper stack separation mechanism 35 and are pressed by at least a front edge of the paper stack separation mechanism 35 so the paper 45 is separated from the staple 41, and will be fed into the cutter elements 36 by the feed rollers 11, 38, 13 and 12. Guide plates 14 and 40 are used to help guide and feed the paper 45 into cutter elements 36. The reciprocating motion of the paper stack separation mechanism 35 will obtain a mechanical delay (as previously described), as shown in FIG. 18*e*, so the paper stack separation mechanism 35 will be stopped here for a period of time to wait for the paper 45 to be fed into the cutter elements 36. The rotating feed roller 13 drives the rotatable feed roller 12 to revolve through the friction between them. In FIG. 18*f*, the paper stack separation mechanism 35 is stopped at the front end (the front end of the reciprocating motion). The rotating feed roller 12 and the rotating feed roller 13 together grasp the paper 45 between them and continuing to feed it into the cutter elements 36. Then, the paper stack separation mechanism 35 prepares to move backward (near the direction of the cutter elements 36).

Figure 18G:
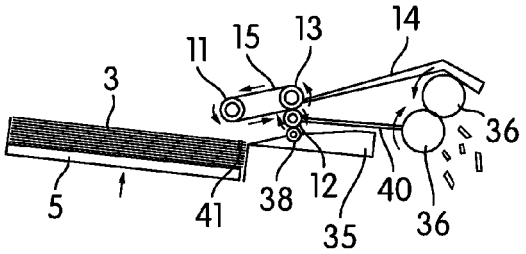

The paper stack separation mechanism 35 is being moved backward (near the direction of the cutter elements 36) in FIG. 18*g*. The rotating cutter elements 36 shreds the paper 45 fed therein as it is also guided by plates 14 and 40. The paper stack separation mechanism 35 has been moved to the rear end in a retracted position near the cutter elements 36. Again, the reciprocating motion of the paper stack separation mechanism 35 is in momentary mechanical delay for a period of time. The rollers and belts continue to move and the movement of the paper stack separation mechanism 35 is repeated until all of the sheets of the stack 3 on the tray 5 are shredded.

Accordingly, the above-described embodiments of the paper feed mechanism and paper stack separation mechanism are not intended to be limiting. For example, the gearing and belts used to time the paper stack separation mechanism can be reduced or eliminated, and/or an additional drive motor could be used in the shredder to drive the gears and belts of that drive system. The amount, positioning, and use of the gears should not be limiting and need not be used. In an embodiment, one or more elastic devices, such as springs, may be used to move the paper stack separation mechanism 35 (e.g., wedge) from an engaged position back to a retracted position. One or more springs can also provide a pause in motion of the paper picker mechanism 35 before it is retracted, and thus a non-undulating motion of the paper picker mechanism 35.

Also, pressure plate 48 (shown in FIGS. 19-20*c* but described previously) could also be attached to any of the embodiments of shredders described in FIGS. 1-18 to press down on the stack.

Furthermore, the speed of movement of tray 5 can be adjusted and/or programmed. In an embodiment, the tray 5 can be programmed and moved along gear rack 20 in a manner such that the rising speed of the tray is incrementally increased, so that a quantity of the paper sheets picked by the paper stack separation mechanism 35 and fed by paper feed mechanism 33 each time it is lifted is increased. Accordingly, the speed of the shredding can improve.

FIG. 19 also shows alternate embodiments for placement of devices with shredder 1 and it housing 4, such as paper feed mechanism 33 and paper stack separation mechanism 35. Cutter elements 36 of shredder mechanism can be located below tray 5. In an embodiment, paper feed mechanism 33 is positioned below the tray 5. For example, as shown, the paper feed mechanism 33 may comprise a drive roller 49 positioned below the sheets 3 and configured to grasp and feed paper to the shredder mechanism. Also, the paper stack separation mechanism 35 may be positioned such that it is below the tray and designed to pick paper from a bottom of the stack 3 on tray 5. The paper stack separation mechanism 35 may be moved in a reciprocating manner between a retracted position away from the stack and an extended position for insertion into at least part of the stack to separate at least an edge of at least one paper sheet therefrom. For example, as shown in FIG. 20*a*, the lid 2 is closed and pressure plate 48 applies downward pressure on stack 3. As the paper stack separation mechanism 35 is moved (via its drive system) towards the stack 3 in FIG. 20*b*, edges of the paper that are picked can be bended downwardly as it encounters the feed rollers 38 and 49. FIG. 20*c* shows the picked paper as it is moved into the cutter elements 36 of the shredder mechanism and shredded. Paper stack separation mechanism 35 may be then be optionally moved to its retracted position away from the stack with the separated and picked sheets are shredded by cutter elements 36.

In an alternative embodiment, the tray 5 and/or housing 4 may include a hinged portion that allows the paper stack separation mechanism 35 to apply pressure thereto and thus move or fold the portion about its hinge as it engages the stack 3. This allows a greater length of the paper to be supported by the tray 5 or housing 4 until the paper stack separation mechanism 35 engages the stack 3.

Figure 22A:
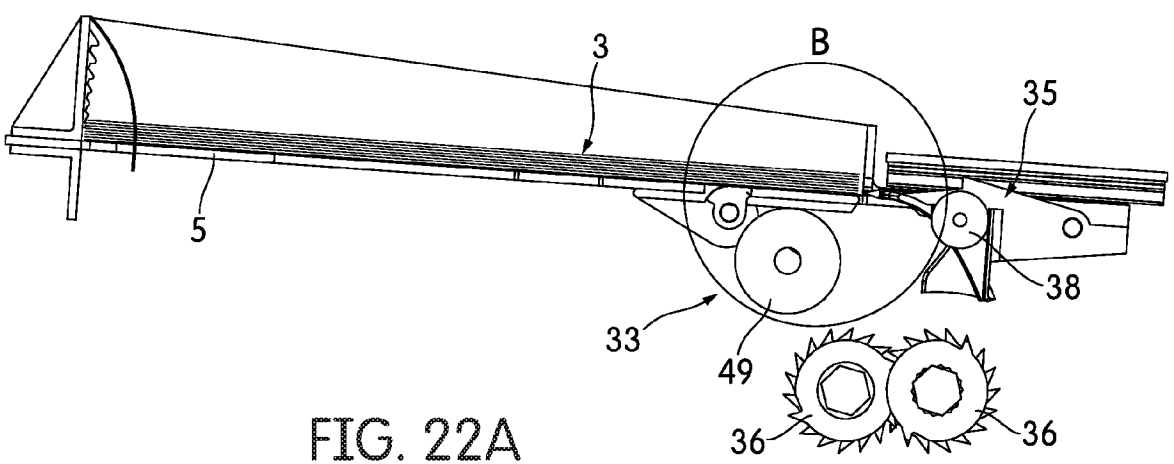
FIGS. 22A and 23A illustrate a partial side view of the alternate paper stack separation mechanism of FIG. 21 in a first paper holding state and a second paper feeding state, respectively.

FIG. 21 illustrates a tray 5 to be used with a shredder 1 in accordance with another embodiment. Cutter elements 36 of shredder mechanism can be located below tray 5, as shown in FIG. 22A, for example. In an embodiment, paper feed mechanism 33 is positioned below the tray 5. For example, as shown, the paper feed mechanism 33 may comprise one or more drive rollers 49 positioned below the sheets 3 and configured to grasp and feed paper to the cutter elements 36 of shredder mechanism 60. Also, the paper stack separation mechanism 35 may be positioned such that it is adjacent or below the tray and designed to pick paper from a bottom of the stack 3 on tray 5. The paper stack separation mechanism 35 may be moved in a reciprocating manner between a retracted position away from the stack and an extended position for insertion into at least part of the stack to separate at least an edge of at least one paper sheet therefrom. One or more rollers 56 may also be provided to at least partially extend through tray 5 to assist in advancing paper or articles to the shredder mechanism.

Figure 22B:
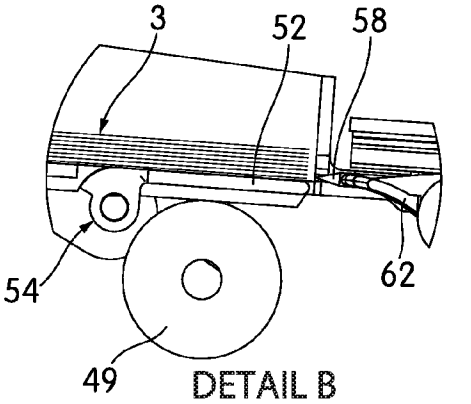
FIGS. 22B and 23B illustrate detailed views of parts of the paper stack separation mechanism in FIGS. 22A and 23A, respectively, in the first and second states.
Figure 23A:
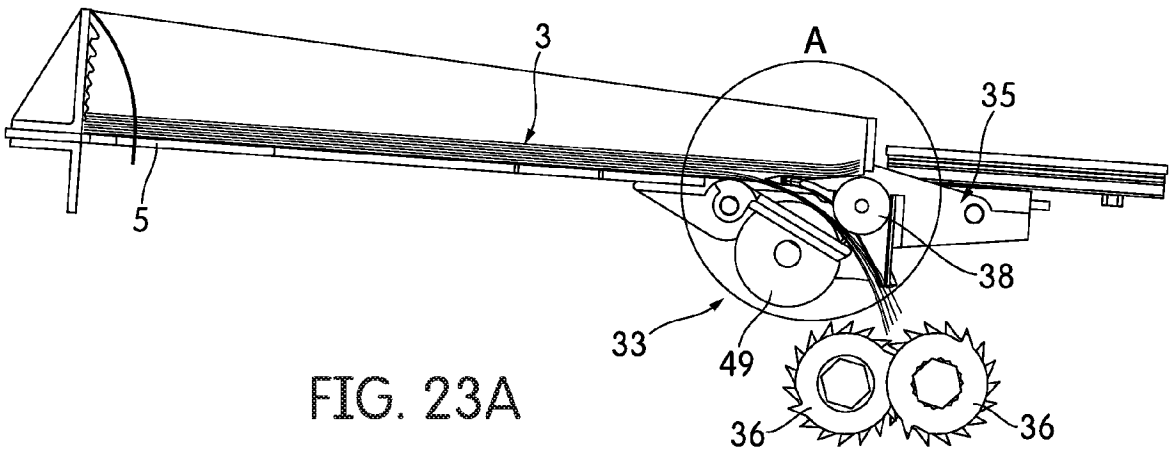

Tray 5 also comprises a pivotable support plate 52 associated therewith that is configured for movement between (a) a first paper holding state to support paper (see FIGS. 22A and 22B) (e.g., a closed position) and (b) a second paper feeding state to allow movement of the paper stack separation mechanism into its extended position for insertion into at least part of the stack (see FIGS. 23A and 23B) (e.g., an open position). For example, in FIG. 22A, as the paper stack separation mechanism 35 is moved (via its drive system) towards the stack 3, the pivotable support plate 52 is rotated from its first state (e.g., a closed position) about its axle 54 or pivot point(s) generally in a downward direction. (Although not shown, the lid 2 is closed and pressure plate 48 applies downward pressure on stack 3). Pivotable support plate 52 may be connected for rotation about its axle 54 via one or more hinges, for example. Once pivotable support plate 52 is rotated downwardly, as seen in detail in FIG. 23B, into an open position, the edges of the paper that are separated and/or picked are bent downwardly as it encounters the feed rollers 38 and 49 (roller 38 being rotated by movement and pressure from roller 49 and paper). FIG. 23A shows the picked paper as it is moved into the cutter elements 36 of the shredder mechanism and shredded. Pivotable support plate 52 in its second paper feeding state can be constructed to assist in guiding the at least one separated paper sheet from the stack in a downward feeding direction to the cutter elements. Paper stack separation mechanism 35 may be then be optionally moved to its retracted position away from the stack with the separated and picked sheets are shredded by cutter elements 36.

Also, pivotable support plate 52 acts as a feed door in that it regulates and supports paper when inserted into the tray 5 (in its first paper holding state) and for separation and feeding into the shredder mechanism (when in its second paper feeding state). The pivotable support plate 52 can be moved in an alternating manner between the two states or positions. It also assists in maintaining the accuracy of the insertion of at least a tip of paper stack separation mechanism 35. For example, the movement of the pivotable support plate 52 from and/or between its first paper holding position to its second paper feeding position can be used to prevent edges of the paper or stack from sagging. Thus, in one embodiment, sensors that are used with shredder 1 can more accurately determine a distance between a bottom of the bed of tray 5 and a tip of the paper stack separation mechanism 35, so that the mechanism 35 can be accurately positioned relative to tray 5 for insertion into the stack.

In another embodiment, sensors need not be used to determine distances between a bottom of the bed of the tray 5 and a tip of the paper stack separation mechanism 35. Not all embodiments need to implement sensing devices for the paper stack separation mechanism 35. For example, in one embodiment, when the pivotable support plate 52 is in a paper holding state (e.g., closed position) such as shown in FIG. 22A, at least a tip of the paper stack separation mechanism 35 is configured to penetrate the stack. In this manner, the paper separation mechanism 35 is more accurately inserted into the stack, since the edge of the stack (as positioned in the tray when the plate 52 is in line therewith) is held in a steady and more reliable position. Limiting the pivotal movement of the plate 52 can reduce or eliminate use of a sensor or sensors with such a configuration. That is, in such an embodiment, there is improved accuracy of the stack position and support to the edge thereof as the tip (which can be at a set distance above the paper bed tray 5) moves into the stack, without use of a sensor. Accordingly, the timing and cycle of movement of the plate 52 between its first and second states or positions (e.g., rotation of the plate 52 at least downwardly) can be adjusted to improve stack penetration accuracy. This may be beneficial in that it can prevent possible inaccuracies in separating an amount of paper (inaccurate thickness) each time the paper separation mechanism penetrates the stack (such as if a leading edge of the stack was continuously sagging downwardly when inserted into the stack), which, in turn, can result in separating and feeding a more than a desired amount (i.e., thicker amount) of paper into the cutters.

In yet another embodiment, the pivotal support plate 52 can be configured to remain open for more than one penetration cycle, i.e., plate 52 can remain in a downward position (e.g., see FIG. 23B) as mechanism 35 moves back (away from the stack) and then forth (into the stack) for at least a second time to feed paper from the stack.

In an embodiment, the pivotal support plate 52 is configured to rotate upwardly about its axle 54 from its second paper feeding state to its first paper holding state once a trailing edge of the separated paper is pulled and separated from the stack.

In another embodiment, if pivotal support plate 52 fails to retract and/or rotate upwardly to its first state (e.g., closed position), an auto reverse forward cleaning cycle can be initiated. The mechanism may be configured to clear itself of any mis-feeds or lodged paper in the mechanism by reversing the rotational movement of the pivotal support plate 52, for example. Once the pivoting support plate 52 returns to its proper home position (first state), the cycle can begin again for feeding and shredding.

Figure 23B:
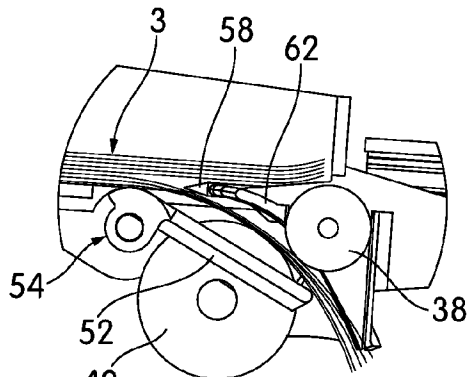

In accordance with one embodiment, the paper stack separation mechanism 35 may include a body 62 that is shaped (e.g., curved) to assist in directing paper into the cutter elements 36. For example, as shown in FIG. 23B, the body may be designed to work with roller 38 to advance the separated paper in a downward direction.

Additionally, in another embodiment, the paper stack separation mechanism 35 in this or any of the other embodiments may comprise a feed separation tip 58. Tip 58 may be a separately attached or an integrated part of paper stack separation mechanism 35. Tip 58 may be generally dull on its edges so as not to cut into paper in the stack, but shaped such that it can first penetrate the stack, e.g., before body 62 of paper stack separation mechanism 35.

Although not specifically shown in FIGS. 19-23B, it should be understood that the elements can be provided with any of the previously described features of shredder 1 in FIGS. 1 and 2, for example.

The type of motor and controller used with any of the embodiments described herein is not meant to be limiting. In an embodiment, a universal motor may be implemented to drive at least the cutter elements of the shredder mechanism.

Also, each of the embodiments described herein do not require that the reciprocating motion be non-undulating motion or include a delay in movement between its engaged and disengaged positions with the stack. Furthermore, it should be understood that the paper stack separation mechanism could also be held in its insertion state for a period of time. One of ordinary skill in the art could provide alternative devices and configurations to enable movement of the paper stack separation mechanism, control, and timing of said movement of the device without straying from the embodiments described herein.

Though not described in detail herein, it should be understood that other devices may be included with shredder 1, in any of the herein disclosed embodiments. For example, a control panel with a screen and buttons may be provided for use with the shredder 1. Lights, LEDs, or other known devices may be provided on control panel. Generally, the use of a control panel is known in the art. Other features, such as those described in the incorporated '235 B2 reference (assigned to the same assignee, Fellowes, Inc.), may also be provided in shredder 1.

A power switch may also be provided on the shredder 1. The power switch may be provided on housing 4, for example, or anywhere else on the shredder 1. The power switch may include a manually engageable portion connected to a switch module (not shown). Movement of the manually engageable portion of switch moves the switch module between states. The switch module is communicated to a controller (not shown) which may include a circuit board. Typically, a power supply (not shown) is connected to the controller by a standard power cord with a plug on its end that plugs into a standard AC outlet. The controller is likewise communicated to the motor of the shredder mechanism. When the switch is moved to an on position, the controller can send an electrical signal to the drive of the motor so that it rotates the cutting elements 36 of the shredder mechanism in a shredding direction, thus enabling paper sheets to be fed therein. The switch may also be moved to an off position, which causes the controller to stop operation of the motor. Further, the switch may also have an idle or ready position, which communicates with the optional control panel. The switch module contains appropriate contacts for signaling the position of the switch's manually engageable portion. Generally, the construction and operation of the switch and controller for controlling the motor are well known and any construction for these may be used. Also, the switch need not have distinct positions corresponding to on/off/idle, and these conditions may be states selected in the controller by the operation of the switch.

Although examples were mentioned above, it should be understood that any number and type of sensors may be used with the shredder 1. In an embodiment, a sensor is provided in housing 4 or on tray 5 for sensing the presence of paper sheets or a stack 3. The sensor may be used to communicate with the controller that sheets are ready to be shredded or destroyed, or to communicate with the feed driver system. The presence of sheets may also start a timer. For example, a time delay may be activated such that paper feed mechanism 33 begins to move or rotate after a set period of time (e.g., 30 minutes, 1 hour). The sensor may be of any type, e.g., optical, electrical, mechanical, etc. and should not be limiting. Additionally, audio and/or vibrations sensors may be used with shredder 1. For example, a sensor may be able to pick-up audio signals or sounds or vibrations when paper is shredding or as paper is lifted.

It should also be understood that any of the herein disclosed embodiments may implement a thickness sensor not only for determining a thickness of the one or more pages that are picked for feeding to the shredder mechanism, but also for controlling the paper stack separation mechanism 35. For example, in an embodiment, thickness sensing may be implemented between the paper stack separation mechanism 35 and feed roller 11 to determine an approximately number of sheets in the stack 3. Based on the detected thickness of stack 3, the height or thickness at which the paper stack separation mechanism 35 is configured to penetrate into can be adjusted (e.g., instead of picking ten sheets from the stack, it can be adjusted to pick five). A sensor (e.g., optical sensor) can be used to sense the movement of the mechanism 35 into the stack 3.

Furthermore, in an embodiment, a thickness sensor can be used to control a speed of the paper stack separation mechanism 35 as it moves between its refracted and extended positions. When a thickness sensor detects a thickness of one or more picked paper sheets that are being advanced by the paper feed mechanism 33 towards cutter elements, it can adjust and/or control the motor speed. Based on the motor speed, the speed of paper stack separation mechanism 35 can also be controlled. In an embodiment, the speed of the paper stack separation mechanism directly correlates to the speed of the motor. For example, if a larger number of sheets are picked from the stack 3, the motor speed may be reduced, and thus the speed at which the paper stack separation mechanism 35 is moved to pick paper can be reduced. However, this is not limiting. Moreover, the speed of the devices need not be controlled by the same drive mechanism or motor.

The separation and advancement mechanisms for "automatically" feeding one or more sheets as described in the herein disclosed embodiments of shredder 1 ideally allow a user to drop off a stack of paper sheets or documents without having the need to manually feed individual or a present quantity of sheets into the shredder 1. For example, a user would add a stack of documents to the tray 5 and be able to walk away. The shredder 1 may then either automatically engage in shredding the documents in the tray 5 (e.g., upon closure of the lid 2 or via sensor 28), or set a preset timer so as to delay the time the shredder 1 is activated for the shredding process to begin. A user may also activate the shredding process by pushing a button.

One advantage of the described separation and advancement mechanisms in shredder 1 is the decreased amount of time a user must spend shredding documents, thus efficiency of operations can be improved. For example, the productivity of a user would be improved since the user is able to perform other tasks while the shredder 1 is activated. Another advantage is that the shredder 1 is designed to handle paper or documents of different sizes, textures, shapes, and thicknesses, including letter, legal, and A4 size paper, as well as envelopes and stapled sheets, for example. The documents may also be in any order.

Optionally, the shredder 1 may be utilized in a system having a centrally located shredder unit for a multitude of users. For example, the shredder 1 allows for each individual to save what they need to shred at a later time in their own individual tray. An individual can fill his or her own tray until shredding is needed. Each individual may then insert the tray into the shredder 1. In an embodiment, each individual tray may comprise a locking mechanism, such that documents may be secured within the tray, as well as to the work area of the individual, for additional security of the documents to be shredded.

The shredder 1 may also be utilized in a system wherein users use a mobile cart device to pick up items to be shred, for example. The cart device may be used to pick up individual trays or allow users to securely add documents that need to be shredded to a locked tray. Thus, other users or services may be used to shred documents without having access to such documents.

Uncertainty with regard to other feed systems is also reduced and/or eliminated. For example, in known systems, an amount of paper sheets being fed is uncertain, so it is easier to overload the cutter elements and cause problems such as paper jams. With the herein disclosed devices, such problems are reduced; before the paper is fed, the paper stack separation mechanism is inserted into the stack so that a smaller part of paper is separated from the other part of the stack. This separated part of paper is fed into the shredding mechanism. Any overload problem with regards to an amount of fed paper sheets is reduced and/or resolved. Moreover, use of a stripper device allows for pulling paper from the stapled stack before it is fed.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the objects of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A method for advancing paper sheets into cutter elements for shredding using a shredder comprising a tray for holding a stack of paper sheets; a motor rotating cutter elements in an interleaving relationship for shredding paper sheets fed therein; a paper stack separation mechanism to separate one or more paper sheets from the stack, the paper stack separation mechanism comprising opposing surfaces configured to separate paper sheets in the stack; and a paper feed mechanism to advance separated paper sheets into the cutter elements; wherein the method comprises:

rotating the cutter elements in an interleaving relationship;

moving the paper stack separation mechanism for insertion of the opposing surfaces into the stack in between paper sheets in the stack to separate one or more paper sheets for feeding into the cutter elements, and driving the feed mechanism in a feeding direction to feed the one or more separated paper sheets to the cutter elements.

2. The method according to claim 1, wherein the moving the paper stack separation mechanism further comprises moving the paper stack separation mechanism in an alternating manner between engaged and retracted positions such that the paper stack separation mechanism alternates between engaging with and insertion of the opposing surfaces into the stack to separate one or more paper sheets for feeding into the cutter elements and disengaging from the stack to allow the cutter elements to advance and shred the paper therethrough.

3. The method according to claim 1, wherein the paper feed mechanism comprises a feed belt mounted on two parallel axles, the feed belt configured for rotation about its axles by rotation of the cutter elements, and wherein the method further comprises:

rotating the feed belt to feed the paper separated by the paper stack separation mechanism to the cutter elements.

4. The method according to claim 3, the shredder further comprising an activation belt mounted on two parallel axles, one of the axles being associated with the cutter elements and the other of the axles being associated with the feed belt of the paper feed mechanism, such that rotation of the axle associated with the cutter elements rotates the activation belt which rotates the axle associated with the feed belt of the paper feed mechanism, and wherein the method further comprises:

rotating the activation belt, and rotating the axle associated with the feed belt of the paper feed mechanism so that the feed belt of the paper feed mechanism is rotated about its axles and driven to advance the one or more separated paper sheets towards and into the cutter elements.

5. The method according to claim 3, wherein the paper feed mechanism further comprises a feed roller that cooperates with the belt to advance paper towards the cutter elements, and wherein the method further comprises: rotating the feed roller.

6. The method according to claim 1, wherein the paper stack separation mechanism comprises a feed roller mounted thereon for applying pressure to grasp paper separated from the stack, and wherein the method further comprises: applying pressure to one or more paper sheets in the stack using the feed roller on the paper stack separation mechanism to separate the one or more paper sheets from the stack.

7. The method according to claim 1, wherein the moving the paper stack separation mechanism further comprises moving the paper stack separation mechanism in a direction parallel to the tray.

8. The method according to claim 1, wherein at least one of the opposing surfaces of the paper stack separation mechanism comprises an angled surface configured to separate the paper sheets in the stack and guide separated paper sheets towards the cutter elements, the method further comprising: guiding separated paper sheets using the angled surface of the paper stack separation mechanism.

9. The method according to claim 2, wherein the paper stack separation mechanism comprises a drive belt mounted on two parallel axles, and wherein the method further comprises:

rotating the drive belt about its axles by rotation of the cutter elements, and wherein the rotation of the drive belt moves the paper stack separation mechanism in its alternating manner between the retracted and extended positions.

10. The method according to claim 9, wherein one of the axles of the drive belt is associated with the cutter elements, and wherein the method further comprises: rotating the drive belt to move the paper stack separation mechanism via rotation of the axle associated with the cutter elements.

11. The method according to claim 2, wherein the method further comprises moving the paper stack separation mechanism between its retracted and extended positions in a non-undulating manner.

12. The method according to claim 2, wherein the method further comprises delaying movement of the paper stack separation mechanism for a period of time in either the retracted or extended positions for a predetermined period of time before moving from either the retracted or extended positions and into an opposite direction of the retracted or extended positions.

13. The method according to claim 1, wherein the tray is configured for movement between a lowered position and a raised position relative to the paper stack separation mechanism, and wherein the method further comprises moving the tray from its lowered position to the raised position such that the stack is configured for feeding to the cutter elements.

14. The method according to claim 1, wherein the shredder further comprises a sensor for detecting a height of the stack on the tray, and wherein the method further comprises:

detecting with the sensor that a predetermined number of paper sheets in the stack are adjacent to or above the paper stack separation mechanism before the rotating of the cutter elements.

15. The method according to claim 1, wherein the shredder further comprises a device for stripping paper sheets that are stapled together in the stack as the one or more separated paper sheets are fed to the cutter elements, and wherein the method further comprises: stripping paper sheets from each other that are stapled together in the stack using the device.

16. The method according to claim 1, wherein the shredder further comprises a pressure plate mounted for movement relative to the stack of paper sheets in the tray and configured to apply pressure to at least a top sheet of the stack, and wherein the method further comprises: applying pressure to at least the top sheet of the stack using the pressure plate.

17. The method according to claim 1, wherein the shredder further comprises a pivotable support plate associated with the tray that is configured for movement between (a) a first paper holding state to support paper and (b) a second paper feeding state to allow movement of the paper stack separation mechanism into its extended position for insertion into at least part of the stack, and wherein the method further comprises: moving the pivotable support plate to its second paper feeding state after the rotating of the cutter elements.

18. The method according to claim 17, wherein, with the pivotable support plate in its second paper feeding state, the method further comprises guiding one or more separated paper sheets from the stack in a downward feeding direction to the cutter elements.

19. A method for shredding using a shredder, the shredder comprising a housing; a shredder mechanism received in the housing and including a motor and cutter elements, the motor rotating the cutter elements in an interleaving relationship for shredding articles fed therein; a tray for holding a stack of articles to be fed into the cutter elements; and a stack handler system positioned adjacent to the tray for separating and feeding articles, the stack handler system comprising opposing surfaces configured for insertion into at least part of the stack to penetrate, separate, and pick a portion of articles from the stack for feeding into the cutter elements; the method comprising:

rotating the cutter elements in an interleaving relationship;

moving the stack handler system relative to the tray to penetrate the opposing surfaces into the stack in between articles to separate and pick a portion of articles from the stack and feeding the picked portion of articles into the cutter elements, and shredding the picked portion of articles using the cutter elements.

20. The method according to claim 19, wherein the shredder further comprises a drive system constructed to move the stack handler system in a feeding direction to feed the picked portion of articles to the cutter elements and wherein the method further comprises moving the stack handler system in a feeding direction to feed the picked portion of articles to the cutter elements.

21. The method according to claim 19, wherein the moving of the stack handler system further comprises moving the stack handler system in an alternating manner between engaged and retracted positions such that the stack handler system alternates between engaging with and penetration of the opposing surfaces into the stack and disengaging from the stack to allow the cutter elements to advance and shred the portion of articles therethrough.

22. The method according to claim 19, wherein the stack handler system comprises a feed roller mounted on thereon, the feed roller configured to apply pressure to grasp articles separated from the stack, and wherein the method further comprises:

rotating the feed roller to feed the picked portion of articles to the cutter elements.

23. The method according to claim 19, wherein the moving of the stack handler system further comprises moving the stack handler system parallel to the tray.

24. The method according to claim 19, wherein at least one of the opposing surfaces of the stack handler system comprises an inclined surface configured to separate the picked portion of articles in the stack and guide the picked portion of articles towards the cutter elements, the method further comprising: guiding the picked portion of articles using the inclined surface.

25. The method according to claim 19, wherein the tray is configured for movement between a lowered position and a raised position relative to the stack handler system, and wherein the method further comprises moving the tray from its lowered position to the raised position such that the stack is configured for feeding to the cutter elements.

26. The method according to claim 19, wherein the shredder comprises a sensor for detecting a height of the stack on the tray, and wherein the method further comprises:

detecting with the sensor that a predetermined number of articles in the stack are adjacent to or above the stack handler system before the rotating of the cutter elements, and wherein the shredder mechanism is activated upon the detection via the sensor.

27. The method according to claim 26, wherein the sensor is configured to detect a height of a top surface of articles in the stack on the tray.

28. The method according to claim 19, wherein the shredder comprises a thickness sensor for determining a thickness of the portion of articles separated from the stack, and wherein the method further comprises:

determining with the sensor the thickness of the separated portion of articles.

29. The method according to claim 28, wherein the stack handler system is configured for adjustment relative to the stack based on the thickness detected by the thickness sensor, and wherein the method further comprises:

adjusting a position of the stack handler system relative to the stack.

30. The method according to claim 29, wherein a speed at which the stack handler system is inserted into at least part of the stack to penetrate and pick the portion of articles from the stack is controlled based on the thickness detected by the thickness sensor.

31. The method according to claim 19, wherein the shredder further comprises a device for stripping articles that are stapled together in the stack as the one or more separated articles are fed to the cutter elements, and wherein the method further comprises using the device for stripping articles.

32. The method according to claim 19, wherein the shredder further comprises a pressure plate mounted for movement relative to the stack of articles in the tray and configured to apply pressure to at least a top article of the stack, and wherein the method further comprises: applying pressure to at least the top article of the stack using the pressure plate.

33. The method according to claim 19, wherein the shredder further comprises a pivotable support plate associated with the tray that is configured for movement between (a) a first holding state to support articles and (b) a second feeding state to allow movement of the stack handler system into its extended position for insertion into at least part of the stack, and wherein the method further comprises: moving the pivotable support plate to its second feeding state.

34. The method according to claim 33, wherein, with the pivotable support plate in its second feeding state, the method further comprises guiding the picked portion of articles from the stack in a downward feeding direction to the cutter elements.

35. The method according to claim 19, wherein the stack handler system is positioned above the tray.

36. The method according to claim 19, wherein the stack handler system is positioned below the tray.

37. The method according to claim 19, wherein the shredder mechanism is positioned below the tray.

38. The method according to claim 19, wherein the cutter elements are positioned adjacent to the tray.

* * * * *